US011151941B1

(12) United States Patent
Shikata et al.

(10) Patent No.: US 11,151,941 B1
(45) Date of Patent: Oct. 19, 2021

(54) DEVICE AND METHOD FOR CONTROLLING A DISPLAY PANEL

(71) Applicant: Synaptics Incorporated, San Jose, CA (US)

(72) Inventors: Atsushi Shikata, Tokyo (JP); Kazuhiro Okamura, Tokyo (JP); Hirobumi Furihata, Tokyo (JP); Shigeru Ota, Tokyo (JP); Makoto Takeuchi, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/893,776

(22) Filed: Jun. 5, 2020

(51) Int. Cl.
*G09G 3/32* (2016.01)
*G09G 3/3258* (2016.01)

(52) U.S. Cl.
CPC ..... *G09G 3/3258* (2013.01); *G09G 3/32* (2013.01); *G09G 2320/0247* (2013.01); *G09G 2320/064* (2013.01); *G09G 2330/023* (2013.01)

(58) Field of Classification Search
CPC ..... G09G 3/3291; G09G 3/3258
See application file for complete search history.

(56) References Cited

U.S. PATENT DOCUMENTS

| | | | | |
|---|---|---|---|---|
| 9,412,304 | B2 * | 8/2016 | Park | G09G 3/007 |
| 10,902,777 | B1 * | 1/2021 | Huang | G09G 3/3291 |
| 2017/0124958 | A1 * | 5/2017 | Pyo | G09G 3/3291 |
| 2020/0160795 | A1 * | 5/2020 | Heo | G09G 3/3291 |

* cited by examiner

*Primary Examiner* — Sardis F Azongha
(74) *Attorney, Agent, or Firm* — Ferguson Braswell Fraser Kubasta PC

(57) ABSTRACT

A display driver includes signal supply circuitry and a power source controller. The signal supply circuitry is configured to update a display panel during a refresh period and not update the display panel during a non-refresh period that follows the refresh period. The power source controller is configured to modify a high-side power source voltage supplied to the display panel at least during the non-refresh period.

19 Claims, 18 Drawing Sheets

DEVICE AND METHOD FOR CONTROLLING A DISPLAY PANEL

FIELD

The disclosed technology generally relates to a device and method for controlling a display panel.

BACKGROUND

One approach to reduce power consumption of a panel display device, such as an organic light emitting diode (OLED) display device and a micro light emitting diode (LED) display device, is to intermittently drive the display panel. A display driver adapted to the intermittent driving may be configured to refresh or update the display panel during a refresh period, while not refresh or updating the display panel during a non-refresh period that follows the refresh period. This scheme may effectively reduce the power consumption during the non-refresh period.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes signal supply circuitry and a power source controller. The signal supply circuitry is configured to update a display panel during a refresh period, not updating the display panel during a non-refresh period that follows the refresh period. The power source controller is configured to modify a power source voltage supplied to the display panel at least during the non-refresh period.

In one or more embodiments, a display device is provided. The display device includes a display panel and a display driver. The display driver is configured to update a display panel during a refresh period, not updating the display panel during a non-refresh period that follows the refresh period. The display driver is further configured to modify a power source voltage supplied to the display panel at least during the non-refresh period.

In one or more embodiments, a method for controlling a display panel is provided. The method includes updating a display panel during a refresh period and not updating the display panel during a non-refresh period that follows the refresh period. The method further includes modify a power source voltage supplied to the display panel at least during the non-refresh period.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
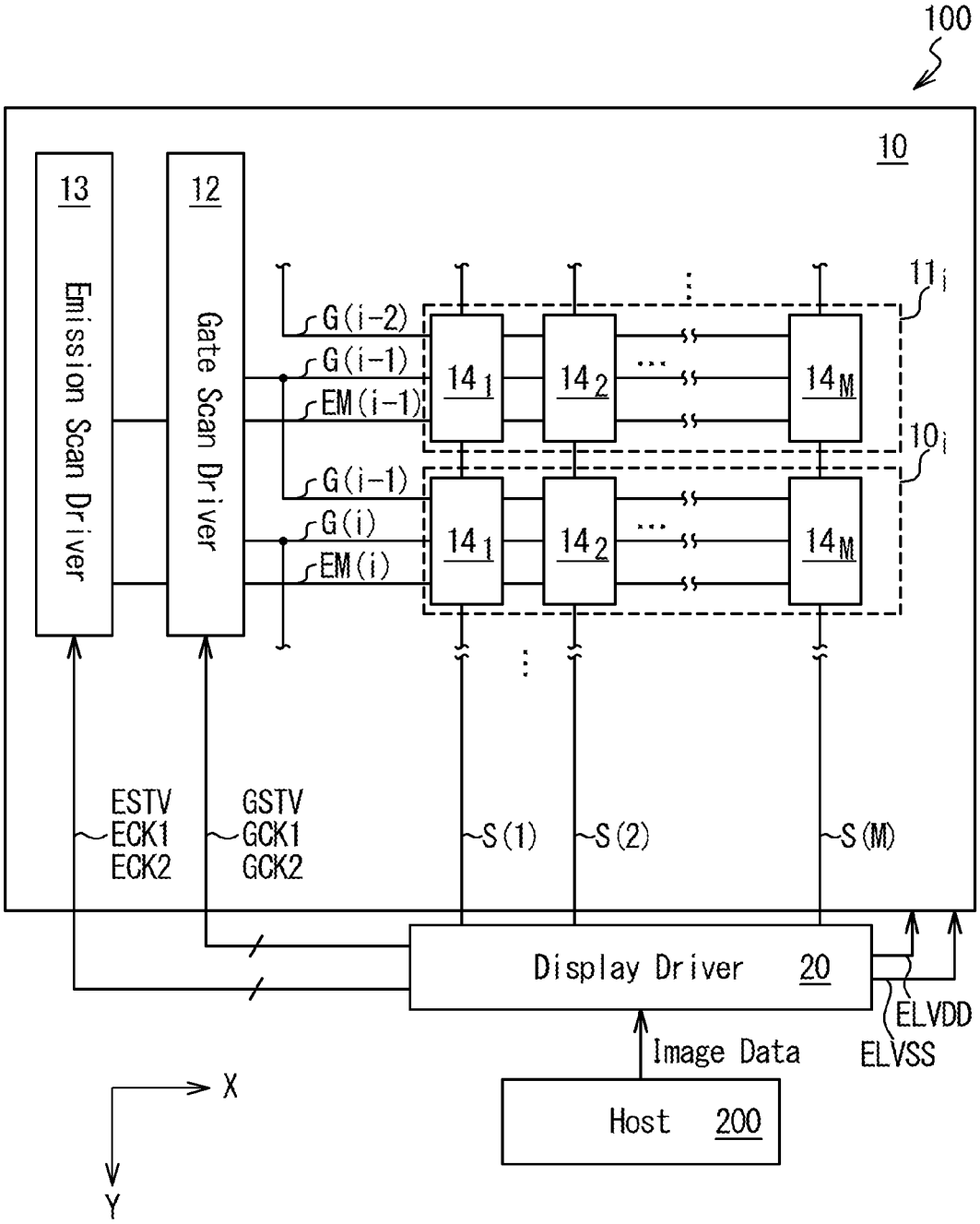
FIG. 1 illustrates an example configuration of a display device, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

Power consumption reduction is an issue for panel display devices, especially for those installed in mobile terminals, such as smart phones, cell phones, mobile personal computers (PCs) and personal digital assistants (PDAs). One approach to reduce power consumption of a panel display device is to intermittently drive the display panel. In one implementation, the display panel may be refreshed or updated only during a refresh period, while not refreshed or updated during a non-refresh period that follows the refresh period. This approach may effectively reduce power consumption of the panel display device.

The intermittent driving may however cause a time-dependent change in the display brightness level of the display panel during the non-refresh period. Pixel circuits of a display panel may be each configured to store a storage voltage corresponding to a grayscale value across a storage capacitor incorporated therein. In such cases, charge leakage from the storage capacitors during a non-refresh period may cause changes in the luminance levels of the pixel circuits. This may be perceived as a change in the display brightness level. When a plurality of refresh periods and non-refresh periods are repeated, repeated changes in the display brightness level may be perceived as a flicker. The present disclosure describes devices and methods that addresses a time-dependent change in the display brightness level during a non-refresh period.

FIG. 1 illustrates an example configuration of a display device 100, according to one or more embodiments. In the illustrated embodiments, the display device 100 includes a display panel 10 and a display driver 20. The display panel 10 may include an OLED display panel, a micro LED display panel, or other self-luminous display panels. The display driver 20 is configured to control the display panel 10 to display an image corresponding to image data received from a host 200 on the display panel 10. Examples of the host 200 may include an application processor, a central processing unit (CPU) or other processors. The display driver 20 may be further configured to supply a high-side power source voltage ELVDD and a low-side power source voltage ELVSS to the display panel 10.

The display panel 10 includes an array of display lines 11 (two illustrated), a gate scan driver 12, and an emission scan driver 13. Each display line 11 includes a row of pixel circuits 14 arrayed in the horizontal direction, which is illustrated as the X-axis direction in FIG. 1. The pixel circuits 14 are each configured to emit light with a luminance level corresponding to a grayscale value specified by the image data. In the illustrated embodiment, each display line 11 includes M pixel circuits $\mathbf{14}_1$ to $\mathbf{14}_M$, where M is a natural number of two or more. The display lines 11 are arrayed in the vertical direction of the display panel 10, which is illustrated as the Y-axis direction in FIG. 1. The i-th display line 11 from the top may be hereinafter referred to as the display line $\mathbf{11}_i$.

The pixel circuits $\mathbf{14}_1$ to $\mathbf{14}_M$ of each display line $\mathbf{11}_i$ are configured to receive gate scan signals G(i−1) and G(i) from the gate scan driver 12, and source signals S(1) to S(M), respectively, from the display driver 20. The pixel circuits $\mathbf{14}_1$ to $\mathbf{14}_M$ of the display line $\mathbf{11}_i$ are configured to be updated using the gate scan signals G(i−1) and G(i) and the source signals S(1) to S(M). In the illustrated embodiment, the updating of the respective pixel circuits 14 include two steps: initialization and programming. The pixel circuits $\mathbf{14}_1$ to $\mathbf{14}_M$ of the display line $\mathbf{11}_i$ are initialized in response to an assertion of the gate scan signal G(i−1). The pixel circuits $\mathbf{14}_1$ to $\mathbf{14}_M$ of the display line $\mathbf{11}_i$ are then programmed with the source signals S(1) to S(M) in response to an assertion of the gate scan signal G(i). Programming of the pixel circuits $\mathbf{14}_1$ to $\mathbf{14}_M$ of the display line $\mathbf{11}_i$ is achieved by asserting the gate scan signal G(i) in the state in which the source signals S(1) to S(M) are generated to have signal levels corresponding to grayscale values specified by the image data associated with the pixel circuits $\mathbf{14}_1$ to $\mathbf{14}_M$ of the display line $\mathbf{11}_i$, respectively.

The pixel circuits 14 of each display line $\mathbf{11}_i$ are further configured to receive an emission scan signal EM(i) that control light emission of the pixel circuits 14 of the display line 11*i*. The pixel circuits 14 of the display line $\mathbf{11}_i$ are configured to emit light when the emission scan signal EM(i) is asserted.

The gate scan driver 12 is configured to generate the gate scan signals G (three gate scan signals G(i−2), G(i−1), and G(i) are illustrated in the figure) in response to a gate scan start pulse signal GSTV and a pair of gate scan shift clocks GCK1 and GCK2 received from the display driver 20. The gate scan driver 12 may be configured as a shift register that performs a shift operation to generate the gate scan signals G in synchronization with the gate scan shift clocks GCK1 and GCK2. The gate scan driver 12 may be configured to sequentially assert the gate scan signals G in response to the gate scan shift clocks GCK1 and GCK2 being cyclically asserted and deasserted. The gate scan driver 12 may be further configured to start the shift operation in response to an assertion of the gate scan start pulse signal GSTV.

The emission scan driver 13 is configured to generate the emission scan signals EM (two emission scan signals EM(i−1) and EM(i) are illustrated in the figure) in response to an emission control signal ESTV and a pair of emission scan shift clocks ECK1 and ECK2 received from the display driver 20. The emission scan driver 13 may be configured as a shift register that performs a shift operation to generate the emission scan signals EM in synchronization with the emission scan shift clocks ECK1 and ECK2 received from the display driver 20. The emission scan driver 13 may be configured to start the shift operation in response to an assertion of the emission control signal ESTV. In one implementation, a series of emission scan signals EM supplied to a series of display lines 11 at the top of the display panel 10 are asserted while the emission control signal ESTV is asserted, and the asserted emission scan signals EM are sequentially shifted by the shift operation.

In one or more embodiments, the emission control signal ESTV may be generated as a pulse-width modulated (PWM) signal that controls the ratio of the number of asserted emission scan signals EM to the total number of the emission scan signals EM (i.e., the ratio of the number of display lines 11 that emit light to the total number of display lines 11) to thereby control the display brightness level of the display panel 10. The display brightness level may be the brightness level of the entire image that is being displayed on the display panel 10. An increase in the ratio of the number of asserted emission scan signals EM to the total number of the emission scan signals EM causes an increased number of pixel circuits 14 to emit light, thereby increasing the display brightness level.

In one or more embodiments, the display brightness level of the display panel 10 is controlled by the duty ratio of the emission control signal ESTV. The duty ratio of the emission control signal ESTV may correspond to the ratio of a period during which the emission control signal ESTV is asserted to one cycle period of the emission control signal ESTV. In one or more embodiments, when the duty ratio of the emission control signal ESTV increases, the ratio of the number of asserted emission scan signals EM to the total number of the emission scan signals EM increases, and the display brightness level of the display panel 10 also increases.

In one or more embodiments, the pixel circuits 14 may be each configured to operate on the high-side power source voltage ELVDD and the low-side power source voltage ELVSS. In such embodiments, the luminance level of light emitted from each pixel circuit 14 may depend on the voltage level of the high-side power source voltage ELVDD and/or that of the low-side power source voltage ELVSS. In some embodiments, the luminance levels of the pixel circuits 14 may increase when the high-side power source voltage ELVDD increases and this leads to an increase in the display brightness level of the display panel 10. In other embodiments, the luminance levels of the pixel circuits 14 may increase when the low-side power source voltage ELVSS decreases and this leads to an increase in the display brightness level.

Figure 2:
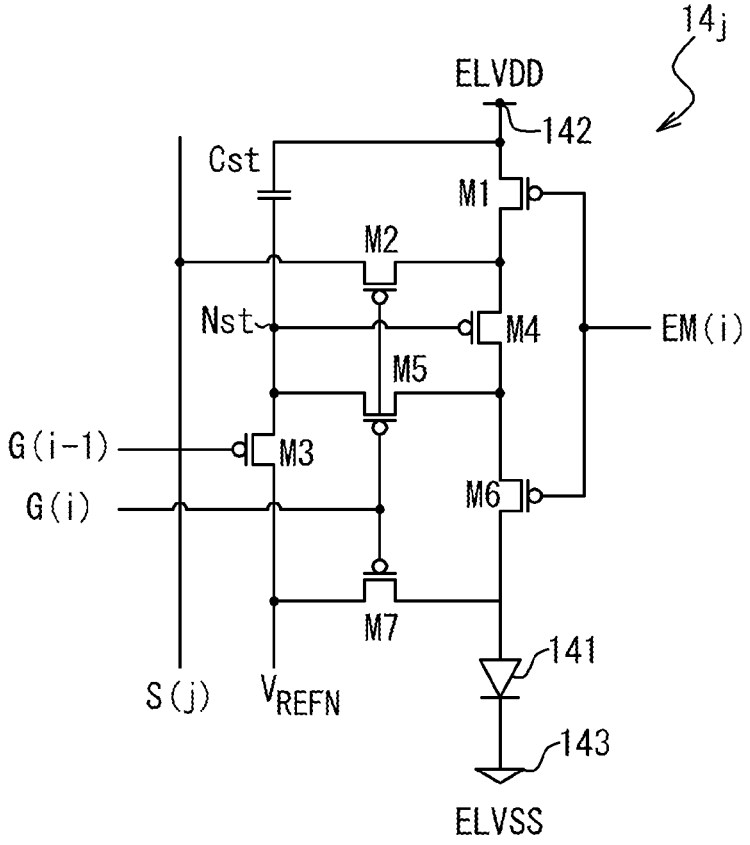
FIG. 2 illustrates an example configuration of a pixel circuit, according to one or more embodiments.

FIG. 2 illustrates an example configuration of the pixel circuit $\mathbf{14}_j$ of the display line $\mathbf{11}_i$, where j is a natural number of one to M, according to one or more embodiments. In the illustrated embodiment, the pixel circuit 14 includes emission control transistors M1, M6, select transistors M2, M3, M5, M7, a drive transistor M4, a storage capacitor Cst, and a light emitting element 141. The transistors M1 to M7 may be configured as positive-channel metal oxide semiconductor (PMOS) transistors. The light emitting element 141 may include an LED, OLED, or other light emitting elements suitable for the type of display panel 10. The emission control transistor M1, the drive transistor M4, the emission control transistor M6, and the light emitting element 141 are connected in series between a high-side power source line 142 configured to supply the high-side power source voltage ELVDD and a low-side power source line 143 configured to supply the low-side power source voltage ELVSS. The emission control transistors M1 and M6 have commonly-connected gates that receive the emission scan signal EM(i). The drive transistor M4 has a gate connected to a storage node Nst. The select transistor M2 has a gate that receives the gate scan signal G(i), a source that receives the source signal S(j), and a drain connected to the source of the drive transistor M4. The select transistor M3 has a gate that receives the gate scan signal G(i−1), a source connected to the storage node Nst, and a drain that receives an initializing voltage $V_{REFN}$. The initializing voltage $V_{REFN}$ may have a fixed voltage level. The select transistor M5 is connected between the drain of the drive transistor M4 and the storage node Nst. The select transistor M5 has a gate that receives the gate scan signal G(i). The select transistor M7 has a gate that receives the gate scan signal G(i), a source that receives the initializing voltage $V_{REFN}$, and a drain connected to the drain of the emission control transistor M6. The storage capacitor Cst is connected between the storage node Nst and the high-side power source line 142. The pixel circuit $\mathbf{14}_j$ thus configured emits light with a luminance level corresponding to the voltage across the storage capacitor Cst.

Figure 3:
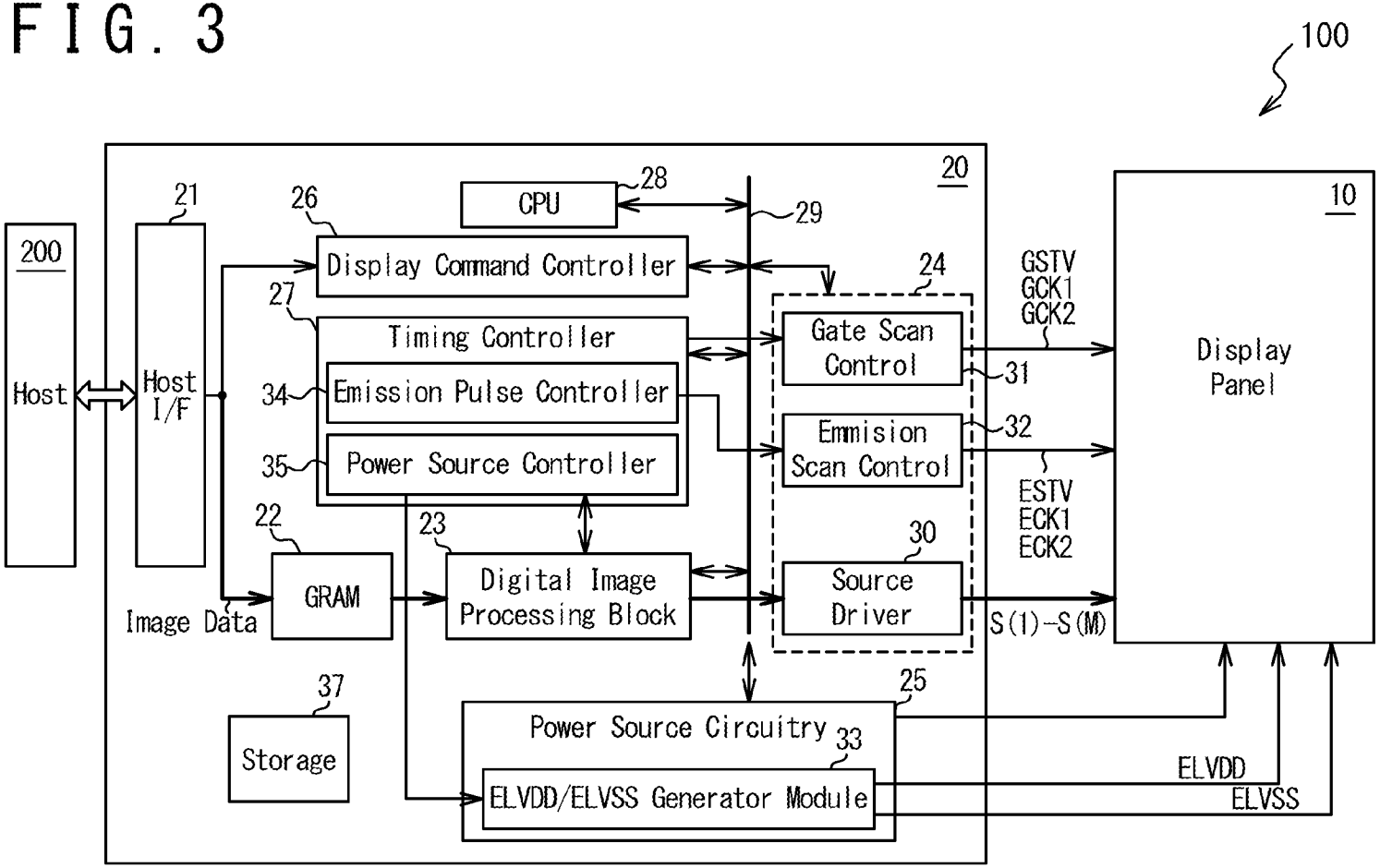
FIG. 3 illustrates an example configuration of a display driver, according to one or more embodiments.

FIG. 3 illustrates an example configuration of the display driver 20, according to one or more embodiments. The display driver 20 is configured to generate and supply the source signals S(1) to S(M), the gate scan start pulse signal GSTV, the gate scan shift clocks GCK1, GCK2, the emission control signal ESTV, and the emission scan shift clocks ECK1 and ECK2 to the display panel 10.

In the illustrated embodiment, the display driver 20 includes host interface circuitry (I/F) 21, a graphic random-access memory (GRAM) 22, a digital image processing block 23, and signal supply circuitry 24. The host interface circuitry 21 is configured to receive image data from the host 200 and forward the received image data to the GRAM 22. In other embodiments, the host interface circuitry 21 may be configured to process the received image data and send the processed image data to the GRAM 22. The GRAM 22 is configured to temporarily store the image data and forward the stored image data to the digital image processing block 23. In other embodiments, the GRAM 22 may be omitted, and the image data may be directly supplied to the digital image processing block 23 from the host interface circuitry 21. The digital image processing block 23 is configured to apply desired image processing (e.g., color adjustment, subpixel rendering, image scaling, and gamma processing) to the image data received from the GRAM 22 and supply the processed image data to the signal supply circuitry 24.

The signal supply circuitry 24 is configured to supply one or more signals to control the display panel 10. In one or more embodiments, the signal supply circuitry 24 includes a source driver 30, a gate scan control signal generator 31, and an emission scan control signal generator 32. The source driver 30 is configured to generate the source signals S(1) to S(M) based on the processed image data received from the digital image processing block 23. The gate scan control signal generator 31 is configured to generate the gate scan start pulse signal GSTV and the gate scan shift clocks GCK1 and GCK2. The emission scan control signal generator 32 is configured to generate the emission control signal ESTV, and the emission scan shift clocks ECK1 and ECK2.

The display driver 20 further includes power source circuitry 25 configured to generate power source voltages used in the display device 100. The power source circuitry 25 includes an ELVDD/ELVSS generator module 33 configured to generate and supply the high-side power source voltage ELVDD and the low-side power source voltage ELVSS.

The display driver 20 further includes a display command controller 26, a timing controller 27, and a CPU 28. The display command controller 26, the timing controller 27, and the CPU 28 are communicatively connected to the digital image processing block 23, the signal supply circuitry 24, and the power source circuitry 25 via a bus 29 and configured to control the operations of the digital image processing block 23, the signal supply circuitry 24, and the power source circuitry 25. In one embodiment, the timing controller 27 includes an emission pulse controller 34 and a power source controller 35. The emission pulse controller 34 is configured to control the generation of the emission control signal ESTV, and the emission scan shift clocks ECK1 and ECK2 by the emission scan control signal generator 32. In some embodiments, the emission pulse controller 34 may be configured to variably control the duty ratio of the emission control signal ESTV to thereby control the display brightness level of the display panel 10. The power source controller 35 is configured to variably control the high-side power source voltage ELVDD and/or the low-side power source voltage ELVSS, which are generated by the ELVDD/ELVSS generator module 33.

The display driver 20 further includes a storage 37 configured to store control data used to control the operation of the display driver 20. The control data may include emission control data, ELVDD control data, and ELVSS control data. The emission control data may be used to control the emission control signal ESTV. For example, the emission control data may indicate the waveform (e.g., assert timing and duty ratio) of the emission control signal ESTV. The ELVDD control data may be used to control the high-side power source voltage ELVDD. For example, the ELVDD control data may indicate the waveform of the high-side power source voltage ELVDD. The ELVSS control data may be used to control the low-side power source voltage ELVSS. For example, the ELVSS control data may indicate the waveform of the low-side power source voltage ELVSS. The emission control data, the ELVDD control data, and the ELVSS control data may be generated and stored in the storage 37 in a calibration process of the display device 100.

In one or more embodiments, the display device 100 has a normal operation mode (which may be also referred to as first mode) and an intermittent operation mode (which may be also referred to as second mode). The display device 100 may be configured to refresh or update the pixel circuits 14 of the display panel 10 every frame period in the normal operation mode. The display device 100 may be further configured to, in the intermittent operation mode, refresh or update the pixel circuits 14 of the display panel 10 during some but not all frame periods. In one implementation, the time domain is segmented into refresh periods during which the pixel circuits 14 of the display panel 10 are updated and non-refresh periods during which no pixel circuits 14 are updated. The refresh periods and the non-refresh periods may be alternately repeated in the time domain. One refresh period may be associated with one or more frame periods, and one non-refresh period may be associated with one or more frame periods.

The switching between the normal operation mode and the intermittent operation mode may be based on the frame rate of the display device 100. The operation mode of the display device 100 may be switched from the normal operation to the intermittent operation mode to reduce the frame rate (e.g., from 60 Hz to 15 Hz or 6 Hz.) The display device 100 may be returned to the normal operation to return to the original frame rate (e.g., from 15 Hz or 6 Hz to 60 Hz.) In one implementation, the host 200 may be configured to send an instruction to switch the operation mode of the display device 100 between the normal operation mode and the intermittent operation mode. In other embodiments, the host 200 may be configured to send an instruction to indicate the frame rate of the display device 100, and the display driver 20 may be configured to switch the display device 100 between the normal operation mode and the intermittent operation mode based on the instruction from the host 200.

Figure 4:
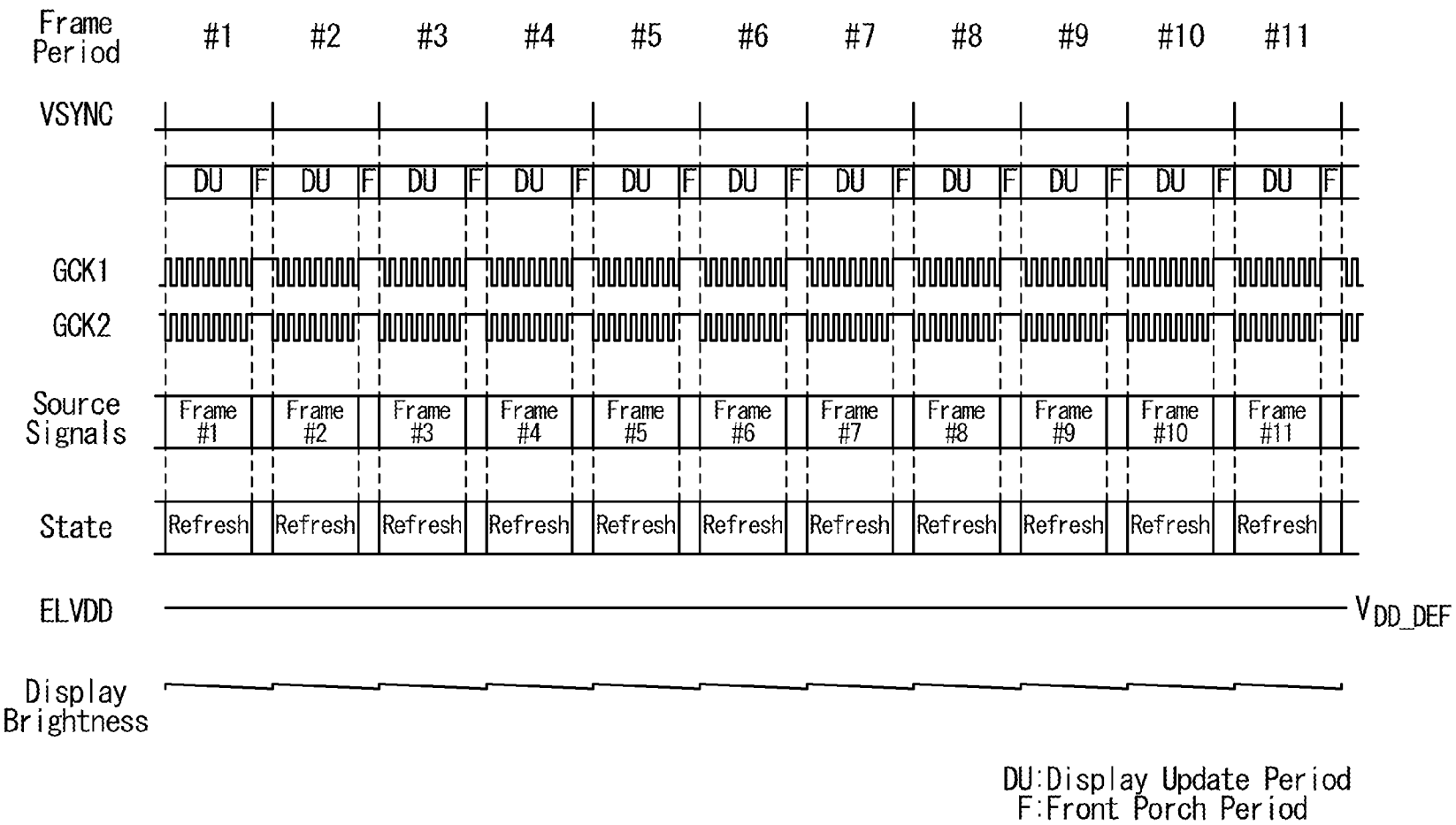
FIG. 4 illustrates an example operation of a display device in a normal operation mode, according to one or more embodiments.

FIG. 4 illustrates an example operation of the display device 100 in the normal operation mode, according to one or more embodiments. In the illustrated embodiment, each frame period includes a display update period and a front porch period that follows the display update period. The display update period, which is indicated by "DU" in FIG. 4, is a period during which the pixel circuits 14 of the display panel 10 are updated. The front porch period, which is indicated by "F" in FIG. 4, is a blanking period during which no pixel circuits 14 are updated. Each frame period may further include a back porch period (not illustrated) at the beginning. The back porch period may be a blanking period used for preparation to drive the display panel 10 in the following display update period.

In one or more embodiments, the pixel circuits 14 of the entire display panel 10 are updated during the display update period in each frame period in the normal operation mode. During frame period #1, for example, the pixel circuits 14 of the display panel 10 are updated during the display update period with the image data associated with frame period #1, and a similar goes for other frame periods. In FIG. 4 (and the following figures), the image data associated with frame period #i is denoted as "Frame #i." In one or more embodiments, in the normal operation mode, the gate scan shift clocks GCK1 and GCK2 are continuously supplied to the display panel 10 during the display update period of each frame period to sequentially assert the gate scan signals G, and the source signals S(1) to S(M) are generated based on the image data associated with the corresponding pixel circuits 14. This achieves updating the pixel circuits 14 of the entire display panel 10 during the display update period of each frame period. In some embodiments, the gate scan shift clocks GCK1 and GCK2 are deasserted during the front porch period to reduce the power consumption. In other embodiments, the gate scan shift clocks GCK1 and GCK2 may be continuously supplied during the entire of the frame period.

The power source controller 35 may be configured to keep the high-side power source voltage ELVDD constant in the normal operation mode. In one or more embodiments, the high-side power source voltage ELVDD is kept at a default voltage level $V_{DD_DEF}$ in the normal operation mode.

Figure 5:
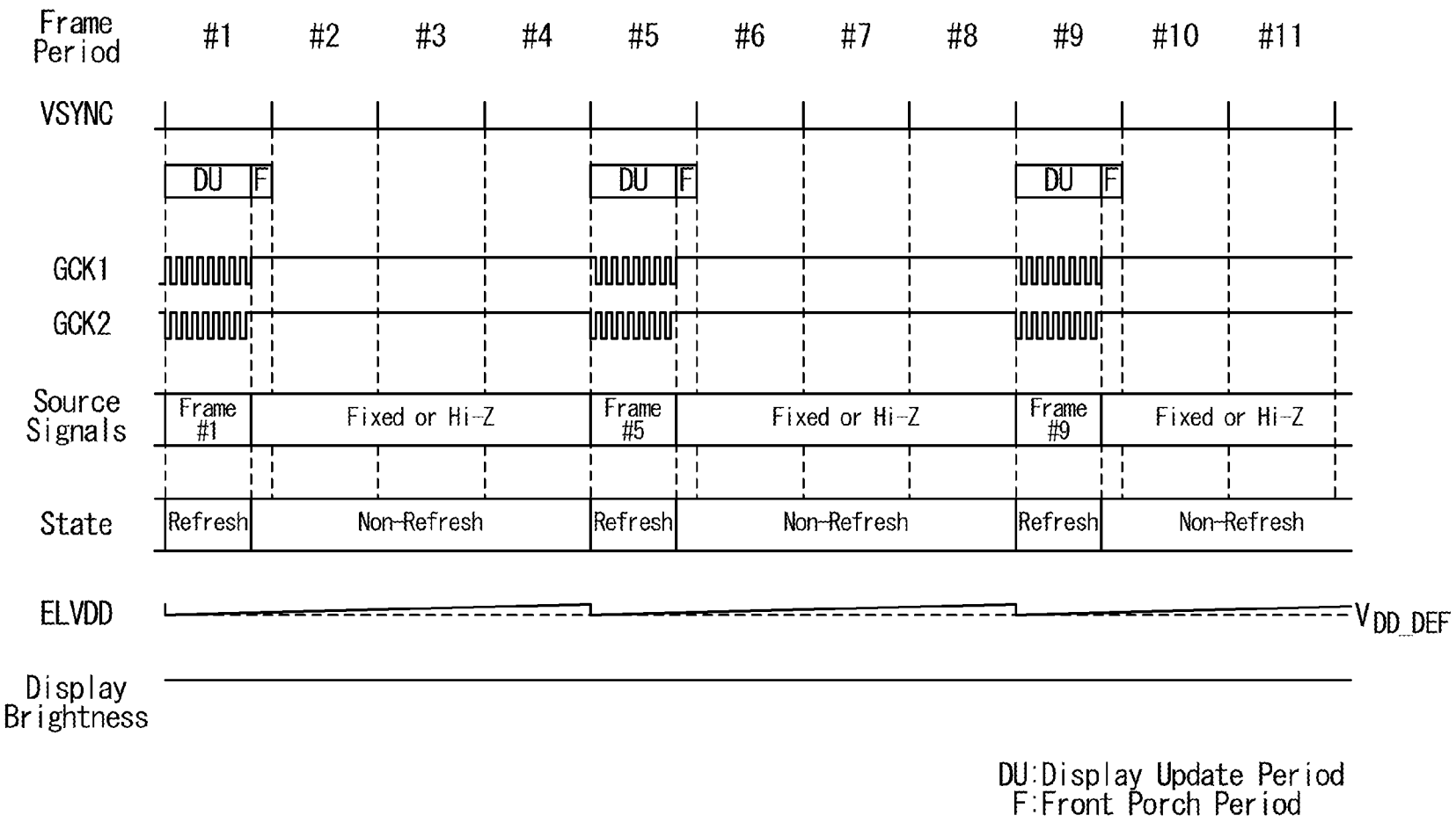
FIG. 5 illustrates an example operation of a display device in an intermittent operation mode, according to one or more embodiments.

FIG. 5 illustrates an example operation of the display device 100 in the intermittent operation mode, according to one or more embodiments. In the illustrated embodiment, the pixel circuits 14 of the display panel 10 are updated during refresh periods, not updated during non-refresh periods, in the intermittent operation mode. In FIG. 5, the refresh periods are indicated by "Refresh", and the non-refresh periods are indicated by "Non-Refresh." The refresh periods and the non-refresh periods are alternately repeated. In the illustrated embodiment, one refresh period includes a display update period of one frame period. In the illustrated embodiment, one non-refresh period includes three frame periods during which no pixel circuits 14 are updated. In other embodiments, one non-refresh period may include one, two, four, or more frame periods. The non-refresh period may further include one front porch period that follows the display update period of the frame period in which the pixel circuits 14 are updated. In the illustrated embodiment, a first refresh period includes the display update period of frame period #1, and a first non-refresh period that follows the first refresh period includes frame periods #2, #3, #4, and the front porch period of frame period #1. A second refresh period includes the display update period of frame period #5, and a second non-refresh period that follows the second refresh period includes frame periods #6, #7, #8, and the front porch period of frame period #5. A third refresh period that follows the second non-refresh period includes the display update period of frame period #9, and a third non-refresh period includes frame periods #10, #11, another not-illustrated frame period, and the front porch period of frame period #9. The number of frame periods included in a non-refresh period may vary, for example, depending on the desired frame rate.

During the display update periods or the refresh periods, the pixel circuits 14 of the display panel 10 are updated with the associated image data. During frame period #1, for example, the gate scan signals G are sequentially asserted while the source signals S are generated based on the image data associated with frame period #1. As a result, the pixel circuits 14 of the display panel 10 are updated with the image data associated with frame period #1. In one implementation, the gate scan shift clocks GCK1 and GCK2 are cyclically asserted and deasserted during the display update period of frame period #1 to allow the update of the pixel circuits 14. In one implementation, the pixel circuits 14 of the display panel 10 are updated during frame periods #5 and #9 in a similar manner.

During the non-refresh periods, the pixel circuits 14 of the display panel 10 are not updated. In one implementation, all the gate scan signals G are kept deasserted during the non-refresh periods, not allowing updating of the pixel circuits 14. In some embodiments, the gate scan control signal generator 31 is configured to keep the gate scan shift clocks GCK1 and GCK2 deasserted during the non-refresh periods in the intermittent operation mode to reduce the power consumption of the display panel 10. In other embodiments, the gate scan shift clocks GCK1 and GCK2 may be kept cyclically asserted and deasserted during the non-refresh periods. In one or more embodiments, the source signals S(1) to S(M) are fixed to a given potential (e.g., the circuit ground level GND, a given power source level, and other fixed potentials) during the non-refresh periods to reduce power consumption of the display device 100. In other embodiments, signal lines on which the source signals S(1) to S(M) are transmitted (which are often referred to as "source lines") are set to high impedance (Hi-Z) during the non-refresh periods.

The power source controller 35 is configured to variably control or modify the high-side power source voltage ELVDD at least during the non-refresh periods in the intermittent operation mode. In the illustrated embodiment, the power source controller 35 is configured to variably control the high-side power source voltage ELVDD during both the refresh periods and the non-refresh periods. The variably controlling of the high-side power source voltage ELVDD may include controlling the high-side power source voltage ELVDD not to be constant. The variably controlling includes adjusting the high-side power source voltage ELVDD at least between a variety of non-zero voltages. The goal of the variably controlling may be to achieve a constant display brightness level. The control of the high-side power source voltage ELVDD may be based on the ELVDD control data stored in the storage 37.

In one or more embodiments, the power source controller 35 is configured to increase the high-side power source voltage ELVDD based on the ELVDD control data to compensate a decrease in the display brightness level during a non-refresh period in the intermittent operation mode. If the voltage level of the high-side power source voltage ELVDD is kept constant during the non-refresh period, the display brightness level may gradually decrease due to charge leakage from the pixel circuits 14. In embodiments where the pixel circuits 14 are configured to increase the luminance levels as the high-side power source voltage ELVDD increases, increasing the high-side power source voltage ELVDD during the non-refresh period may effectively suppress or eliminate the decrease in the display brightness level. In various embodiments, the power source controller 35 may be configured to increase the high-side power source voltage ELVDD during the non-refresh period to keep the display brightness level substantially constant.

In one or more embodiments, the power source controller 35 may be configured to increase the high-side power source voltage ELVDD during a refresh period (or a display update period) and the following non-refresh period until a next refresh period starts. In one implementation, the high-side power source voltage ELVDD is set to the default voltage level $V_{DD_DEF}$ at the beginning of the refresh period (or the display update period). The power source controller 35 may be further configured to start increasing the high-side power source voltage ELVDD at the beginning of the refresh period. The display brightness level may decrease during a refresh period if the high-side power source voltage ELVDD is kept constant during the refresh period. Starting increasing the voltage level of the high-side power source voltage ELVDD at the beginning of the refresh period may effectively suppress or eliminate the decrease in the display brightness level. The power source controller 35 may be further configured to increase the high-side power source voltage ELVDD up to a voltage level higher than the default voltage level $V_{DD_DEF}$ at the end of the non-refresh period. The power source controller 35 may be further configured to return the voltage level of the high-side power source voltage ELVDD to the default voltage level $V_{DD_DEF}$ such that the high-side power source voltage ELVDD is at the default voltage level $V_{DD_DEF}$ at the beginning of the next refresh period.

In some embodiments, the high-side power source voltage ELVDD may be continuously increased during both the refresh period and the non-refresh period. In one implementation, the high-side power source voltage ELVDD may have a ramp waveform. In other embodiments, the voltage level of the high-side power source voltage ELVDD may be increased stepwise. The waveform of the high-side power source voltage ELVDD may be controlled based on the ELVDD control data stored in the storage 37 of the display driver 20. While FIG. 5 illustrates that the high-side power source voltage ELVDD linearly varies over time (e.g., the change rate of ELVDD is constant), the change rate of the high-side power source voltage ELVDD may vary over time. In one or more embodiments, the change rate of the high-side power source voltage ELVDD may be controlled based on the ELVDD control data.

Figure 6:
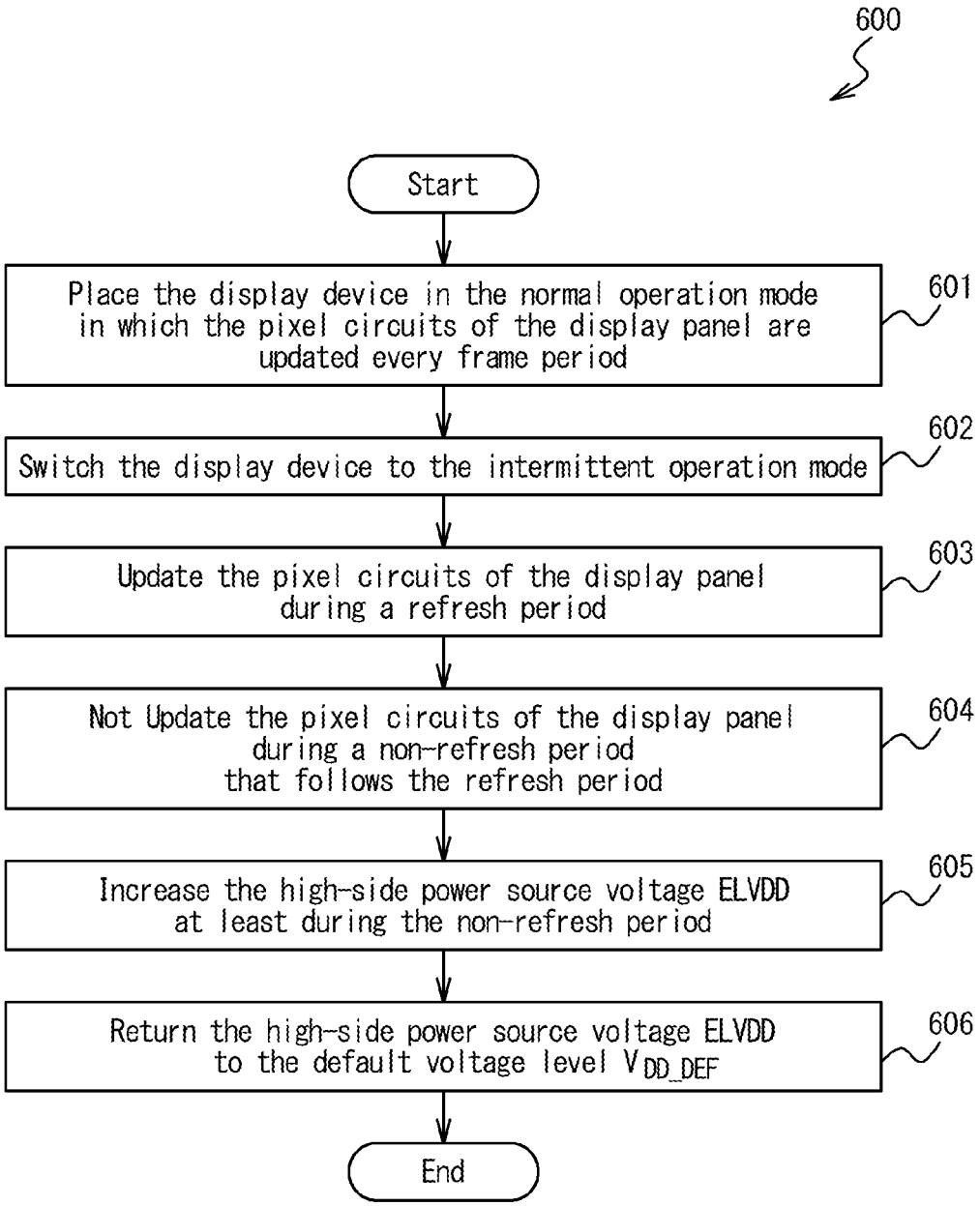
FIG. 6 illustrates an example method for controlling a display panel, according to one or more embodiments.

Method 600 of FIG. 6 illustrates steps for operating the display device 100, according to one or more embodiments. One or more of the steps illustrated in FIG. 6 may be omitted, repeated, and/or performed in a different order than the order illustrated in FIG. 6.

In step 601, the display device 100 is placed in the normal operation mode. In the normal operation mode, all the pixel circuits 14 of the display panel 10 are updated every frame period, and the high-side power source voltage ELVDD is kept constant. The high-side power source voltage ELVDD may be kept at the default voltage level $V_{DD_DEF}$ in step 601.

In step 602, the display device 100 is switched to the intermittent operation mode. In various embodiments, the switching is responsive to an instruction received from the host 200. In some embodiments, the instruction may indicate the switching to the intermittent operation mode. In other embodiments, the instruction may indicate a desired frame rate, and the display driver 20 may switch the display device 100 to the intermittent operation mode to achieve the desired frame rate. In step 603, the pixel circuits 14 of the display panel 10 are updated during a refresh period. This is followed by not updating the pixel circuits 14 of the display panel 10 in a non-refresh period that follows the refresh period in step 604.

The high-side power source voltage ELVDD is controlled to increase at least during the non-refresh period in step 605. This may effectively compensate a decrease in the display brightness level of the display panel 10. The control of the high-side power source voltage ELVDD may be based on the ELVDD control data stored in the storage 37 of the display driver 20. In one or more embodiments, the high-side power source voltage ELVDD is increased during both the refresh period and the non-refresh period. The high-side power source voltage ELVDD may start to be increased at the beginning of the refresh period. The high-side power source voltage ELVDD may be increased up to a given voltage level higher than the default voltage level $V_{DD_DEF}$ at the end of the non-refresh period. In step 606, the high-side power source voltage ELVDD may be returned to the default voltage level $V_{DD_DEF}$ such that the high-side power source voltage ELVDD is at the default voltage level $V_{DD_DEF}$ at the beginning of the next refresh period that follows the non-refresh period.

In embodiments where the high-side power source voltage ELVDD is controlled based on the ELVDD control data stored in the storage 37, the ELVDD control data may be generated and stored into the storage 37 in a calibration process of the display device 100. In the following, a description is given of an example calibration process to generate the ELVDD control data for a display device 100 to be calibrated with reference to FIGS. 7A to 7C.

Figure 7A:
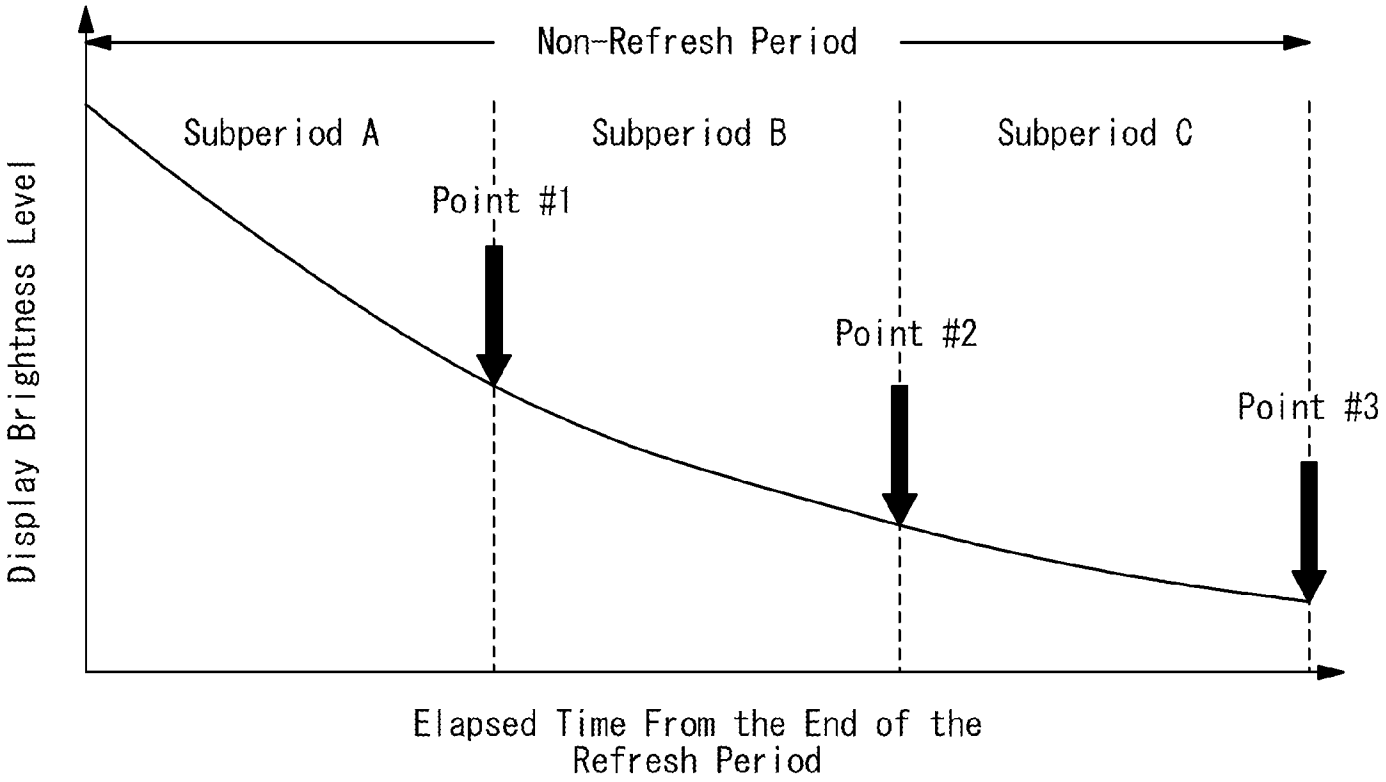
FIG. 7A to 7C illustrate an example calibration process to configure a display driver with ELVDD control data.

FIG. 7A illustrates an example change in the display brightness level over time during a non-refresh period in the case when a test image (e.g., the all-white image) is displayed on the display panel 10 while the high-side power source voltage ELVDD is kept constant. The display brightness level may decrease over time during the non-refresh period.

Figure 7B:
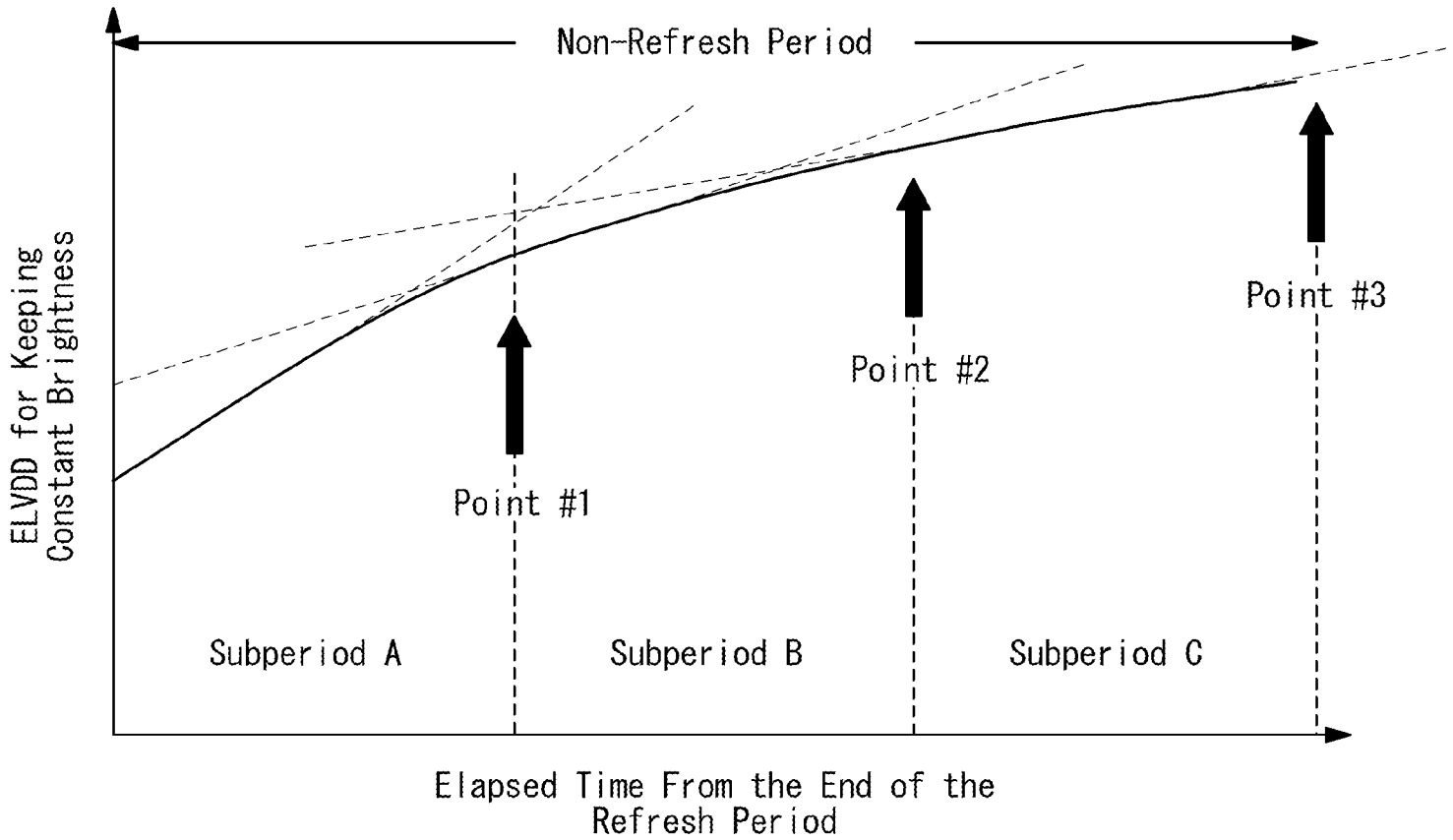

FIG. 7B illustrates an example change in the high-side power source voltage ELVDD that maintains the display brightness level. In one or more embodiments, the calibration process includes determining the voltage levels of the high-side power source voltage ELVDD that keep the display brightness level constant for a plurality of time points in the non-refresh period for the display device 100 to be calibrated. In one implementation, the non-refresh period is segmented into a plurality of subperiods, and the plurality of time points are defined as the ends of the plurality of subperiods, respectively. In the illustrated embodiment, the non-refresh period is segmented into three subperiods A, B, and C, and time points #1, #2, and #3 are defined at the ends of the subperiods A, B, and C. The voltage levels of the high-side power source voltage ELVDD that keep the display brightness level constant are determined for time points #1, #2, and #3, respectively. In one or more embodiments, the voltage levels of the high-side power source voltage ELVDD that keep the display brightness level constant may be determined in the calibration process by actually measuring such the voltage levels at the plurality of time points in the state in which the test image is displayed on the display panel 10 of the display device 100. In one or more embodiments, the ELVDD control data may be generated based on the thus-determined voltage levels of the high-side power source voltage ELVDD that keep the display brightness level constant.

In one implementation, the average change rate of the high-side power source voltage ELVDD that keeps the display brightness level constant may be determined for each subperiod based on the corresponding voltage level of the high-side power source voltage ELVDD at the end of the subperiod, and the ELVDD control data may be generated to include an ELVDD change rate table indicative of a change rate of the high-side power source voltage ELVDD to be supplied to the display panel 10 for each subperiod of the non-refresh period. The change rate of the high-side power source voltage ELVDD to be supplied to the display panel 10 for each subperiod may be determined based on the average change rate of the high-side power source voltage ELVDD that keeps the display brightness level constant during the subperiod. For the embodiment illustrated in FIG. 7C, the change rate of the high-side power source voltage ELVDD to be supplied to the display panel 10 for each subperiod is determined as the average change rate of the high-side power source voltage ELVDD that keeps the display brightness level constant during the subperiod.

Figure 7C:
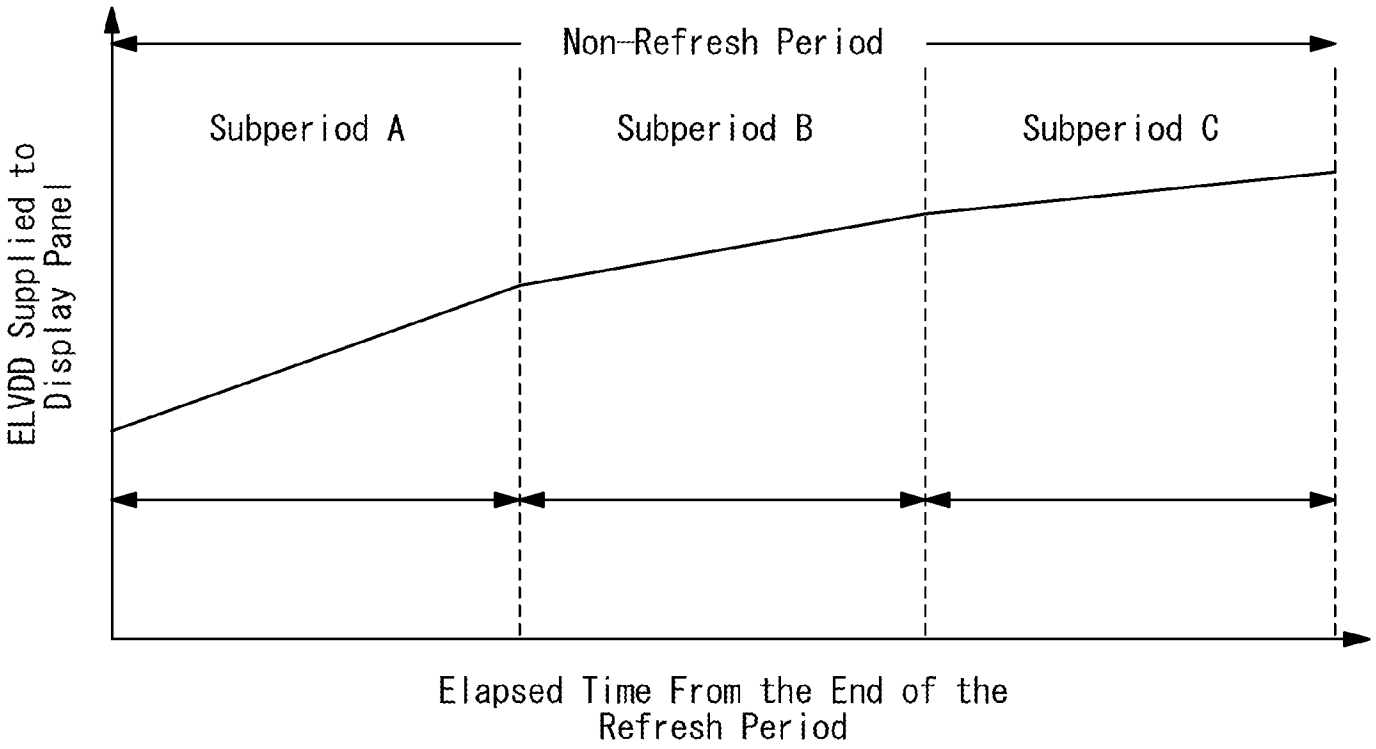

FIG. 7C illustrate an example waveform of the high-side power source voltage ELVDD supplied to the display panel 10 based on the ELVDD control data thus generated. In one or more embodiments, the power source controller 35 is configured to variably control the change rate of the high-side power source voltage ELVDD based on the ELVDD change rate table contained in the ELVDD control data. The ELVDD change rate table may be configured to monotonically increase the high-side power source voltage ELVDD such that the change rate (e.g., increase rate) is variable. In the illustrated embodiment, the change rates during subperiods A, B, and C are different from one another.

Figure 8:
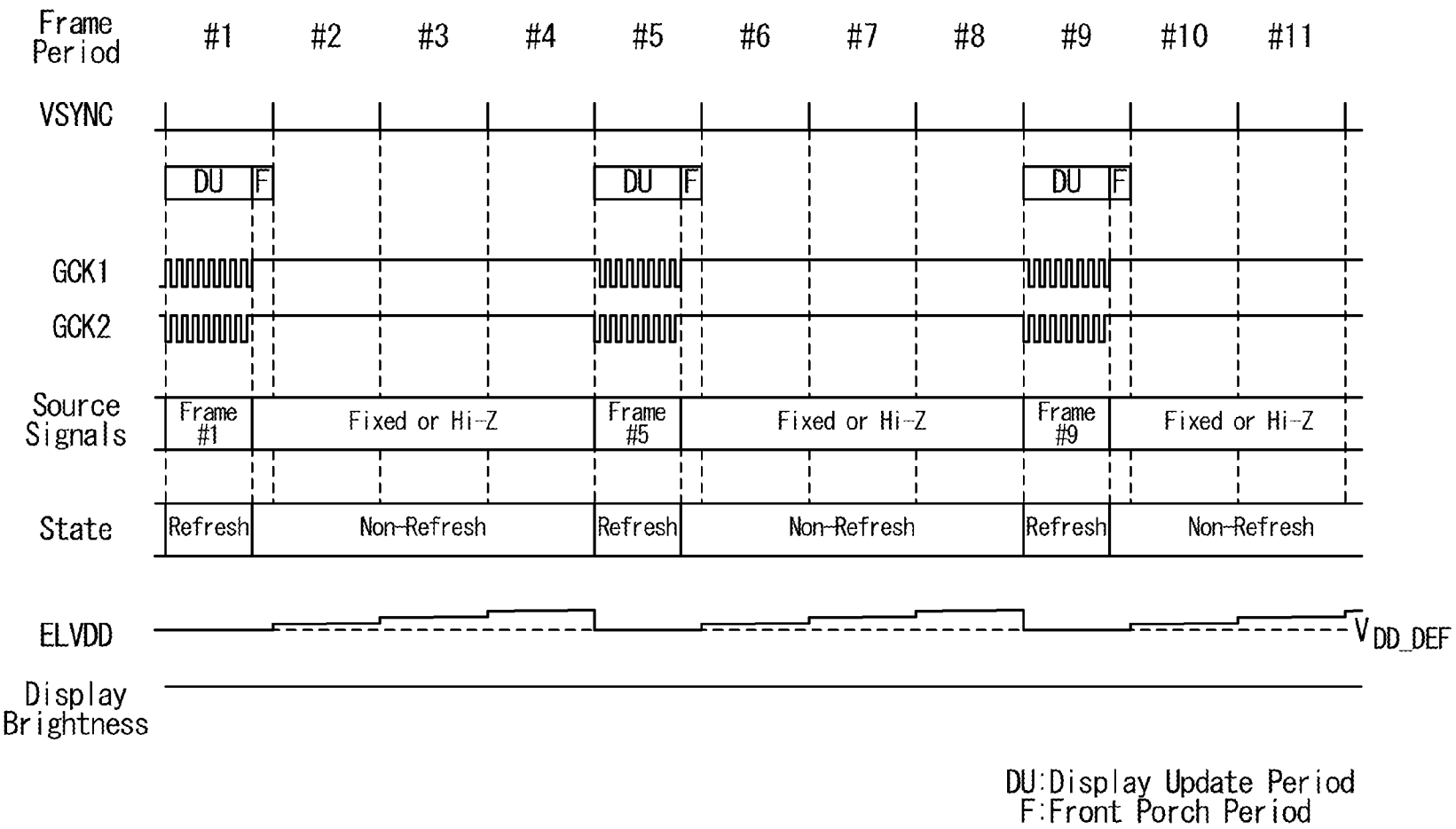
FIG. 8 illustrates an example operation of a display device in an intermittent operation mode, according to other embodiments.

FIG. 8 illustrates an example operation of the display device 100 in the intermittent operation mode, according to other embodiments. In the illustrated embodiment, the high-side power source voltage ELVDD is increased stepwise during a non-refresh period. In some embodiments, the power source controller 35 (illustrated in FIG. 3) is configured to adjust the high-side power source voltage ELVDD to a voltage level that compensates (e.g., reduces or eliminates) the decrease in the display brightness level at the beginning of each frame period during the non-refresh period and maintain the high-side power source voltage ELVDD during that frame period. The adjustment of the high-side power source voltage ELVDD may be based on the ELVDD control data stored in the storage 37.

Figure 9:
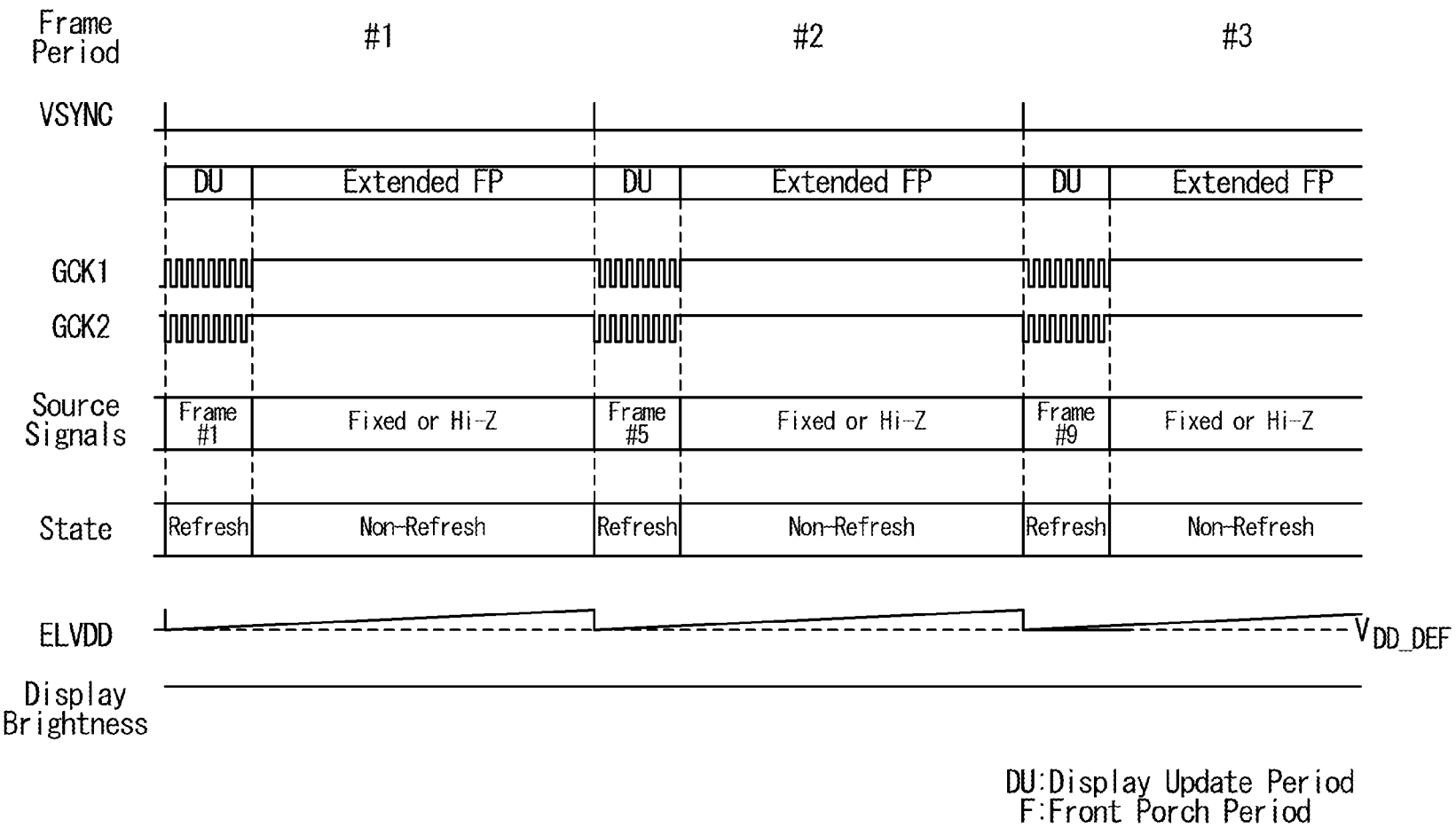
FIG. 9 illustrates an example operation of a display device in an intermittent operation mode, according to other embodiments.

FIG. 9 illustrates an example operation of the display device 100 in the intermittent operation mode, according to still other embodiments. In the illustrated embodiment, the front porch period of each frame period is extended to reduce the frame rate (e.g., from 60 Hz to 15 Hz) when the display device 100 is placed in the intermittent operation mode. In FIG. 9, "Extended FP" indicates the extended front porch period. The extended front porch period in the intermittent operation mode is longer than the front porch period in the normal operation mode. The timing controller 27 (illustrate in FIG. 3) may be configured to switch the display device 100 to the intermittent operation mode in response to an instruction to reduce the frame rate from the host 200.

In the embodiment illustrated in FIG. 9, a refresh period includes a display update period, and a non-refresh period that follows the refresh period includes an extended front porch period that follows the display update period. The high-side power source voltage ELVDD may be gradually increased at least during the extended front porch period in the intermittent operation mode. In some embodiments, the high-side power source voltage ELVDD may be gradually increased during both the display update period and the extended front porch period. In other embodiments, the high-side power source voltage ELVDD may be increased stepwise in the extended front porch period.

In other embodiments, the compensation of the decrease in the display brightness level may be achieved by variably controlling or modifying the low-side power source voltage ELVSS in place of or in addition to the above-described control of the high-side power source voltage ELVDD. In embodiments where the pixel circuits 14 are configured to increase the luminance levels when the low-side power source voltage ELVSS decreases, decreasing the low-side power source voltage ELVSS during a non-refresh period may effectively compensate a decrease in the display brightness level which may be caused by charge leakage from the pixel circuits 14 during the non-refresh period.

Figure 10:
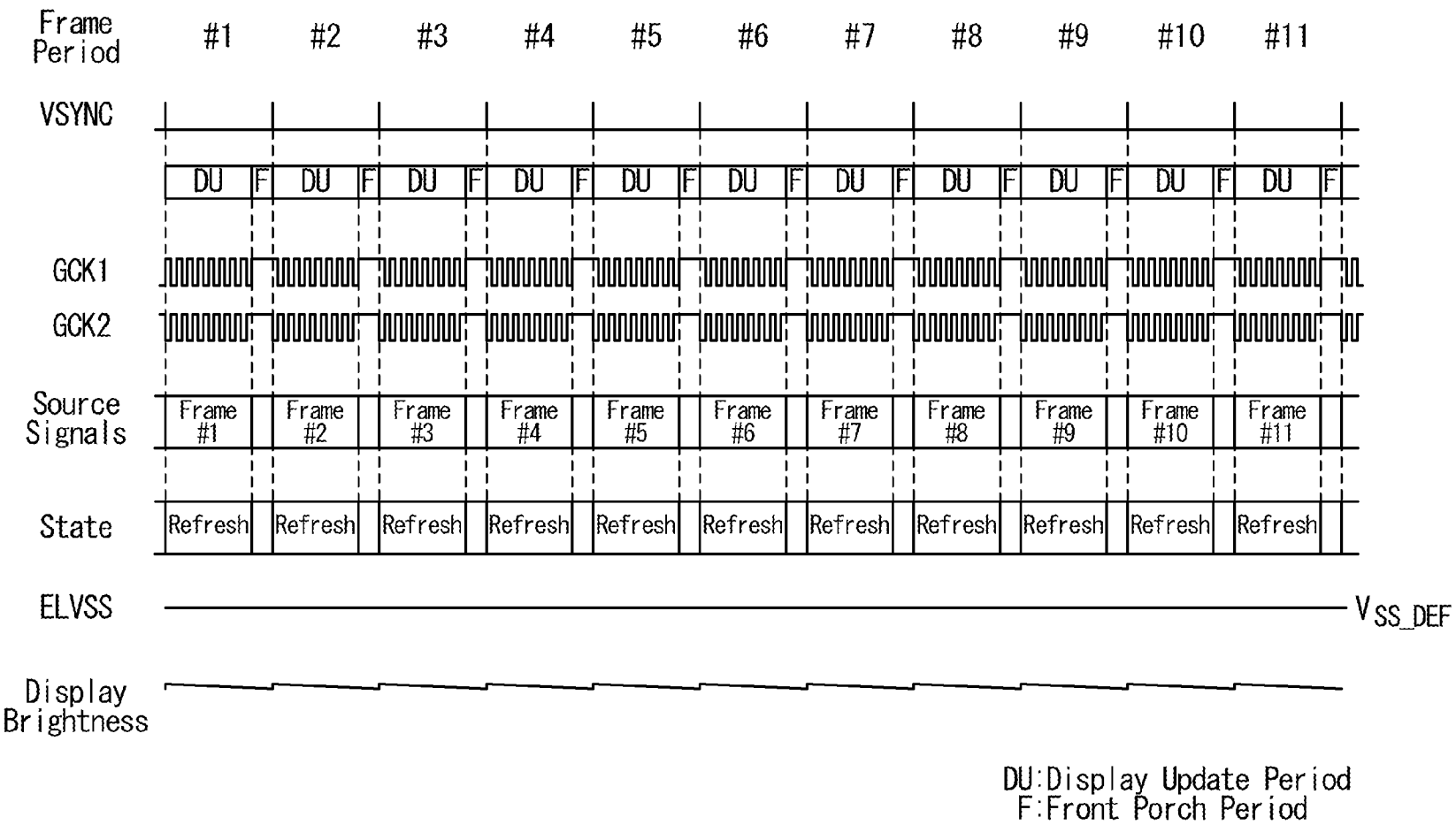
FIG. 10 illustrates an example operation of a display device in a normal operation mode, according to one or more embodiments.
Figure 11:
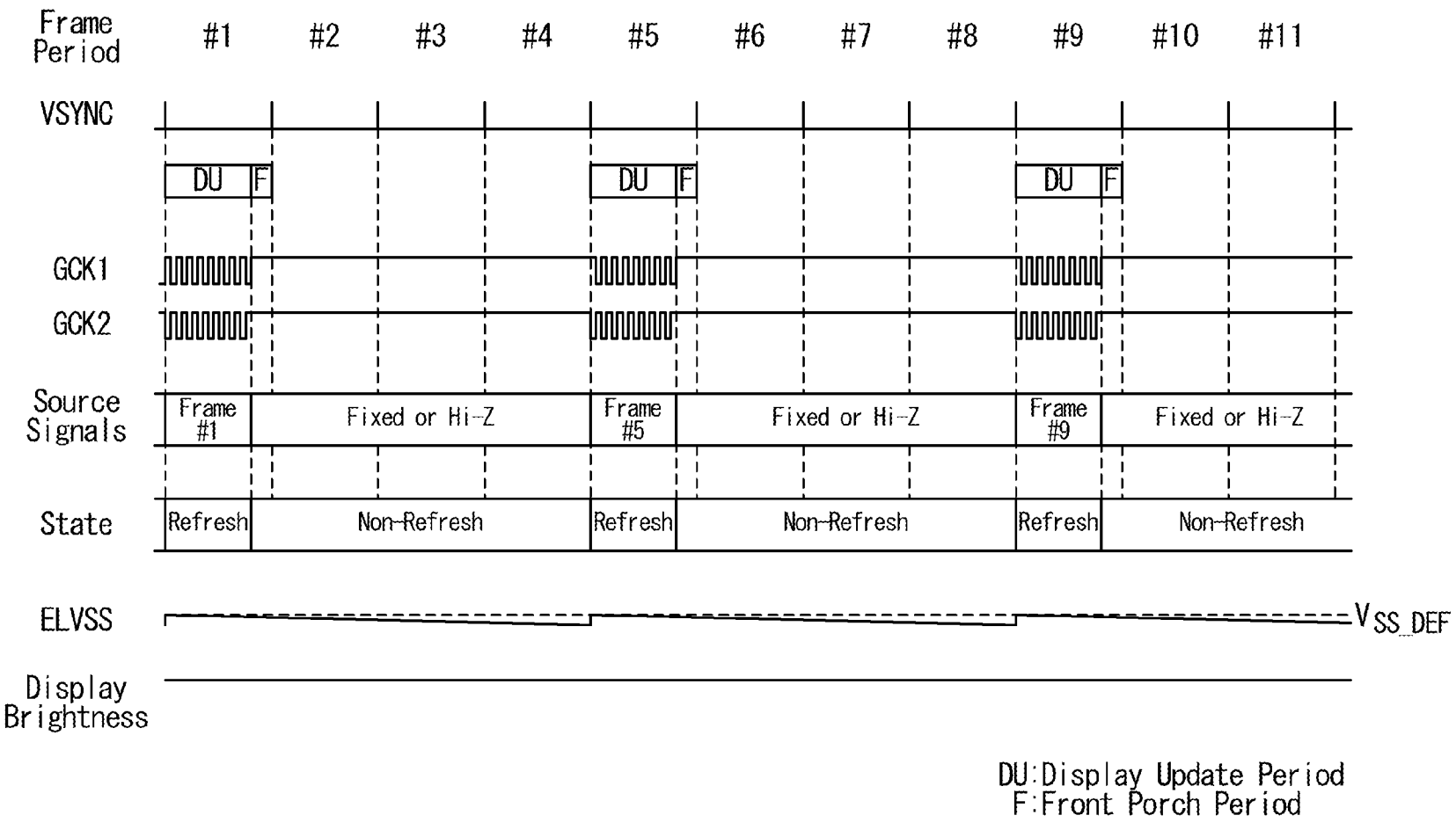
FIG. 11 illustrates an example operation of a display device in an intermittent operation mode, according to one or more embodiments.

FIG. 10 and FIG. 11 illustrate example operations of the display device 100 in the normal operation mode and the intermittent operation mode, respectively, according to such embodiments. In the normal operation mode, as illustrated in FIG. 10, the pixel circuits 14 of the entire display panel 10 are updated every frame period, similarly to the embodiment illustrated in FIG. 4. The power source controller 35 is configured to keep the low-side power source voltage ELVSS constant in the normal operation mode. In one or more embodiments, the low-side power source voltage ELVSS is kept at a default voltage level $V_{SS_DEF}$ in the normal operation mode.

In the intermittent operation mode, as illustrated in FIG. 11, the power source controller 35 is configured to variably control or modify the low-side power source voltage ELVSS at least during the non-refresh periods. In the illustrated embodiment, the power source controller 35 is configured to variably control the low-side power source voltage ELVSS during both the refresh periods and the non-refresh periods. The variable control of the low-side power source voltage ELVSS may include controlling the low-side power source voltage ELVSS not to be constant. The control of the low-side power source voltage ELVSS may be based on the ELVSS control data stored in the storage 37.

In the embodiment illustrated in FIG. 11, the power source controller 35 is configured to decrease the voltage level of the low-side power source voltage ELVSS at least during a non-refresh period to compensate a decrease in the display brightness level in the intermittent operation mode. In one implementation, the power source controller 35 may be configured to decrease the voltage level of the low-side power source voltage ELVSS during a refresh period and a non-refresh period following the refresh period. The power source controller 35 may be configured to start decreasing the voltage level of the low-side power source voltage ELVSS at the beginning of the refresh period and decrease the voltage level of the low-side power source voltage ELVSS down to a voltage level lower than the default voltage level $V_{SS_DEF}$ at the end of the following non-refresh period. The power source controller 35 may be further configured to return the voltage level of the low-side power source voltage ELVSS to the default voltage level $V_{SS_DEF}$ such that the low-side power source voltage ELVSS is at the default voltage level $V_{SS_DEF}$ at the beginning of the next refresh period. In some embodiments, the low-side power source voltage ELVSS may be continuously decreased during both the refresh period and the non-refresh period. In one implementation, the low-side power source voltage ELVSS may have a ramp waveform. In other embodiments, the voltage level of the low-side power source voltage ELVSS may be decreased stepwise. In one implementation, similarly to the embodiment described in relation to the FIG. 8, the power source controller 35 may be configured to adjust the low-side power source voltage ELVSS to a voltage level that compensates (e.g., reduces or eliminates) the decrease in the display brightness level at the beginning of each frame period during the non-refresh period and maintain the low-side power source voltage ELVSS during that frame period. The waveform of the low-side power source voltage ELVSS may be controlled based on the ELVSS control data stored in the storage 37 of the display driver 20. The ELVSS control data may be generated and stored into the storage 37 in a calibration process of the display device 100. The ELVSS control data may be generated in a similar manner to the ELVDD control data as described in relation to FIGS. 7A to 7C.

Figure 12:
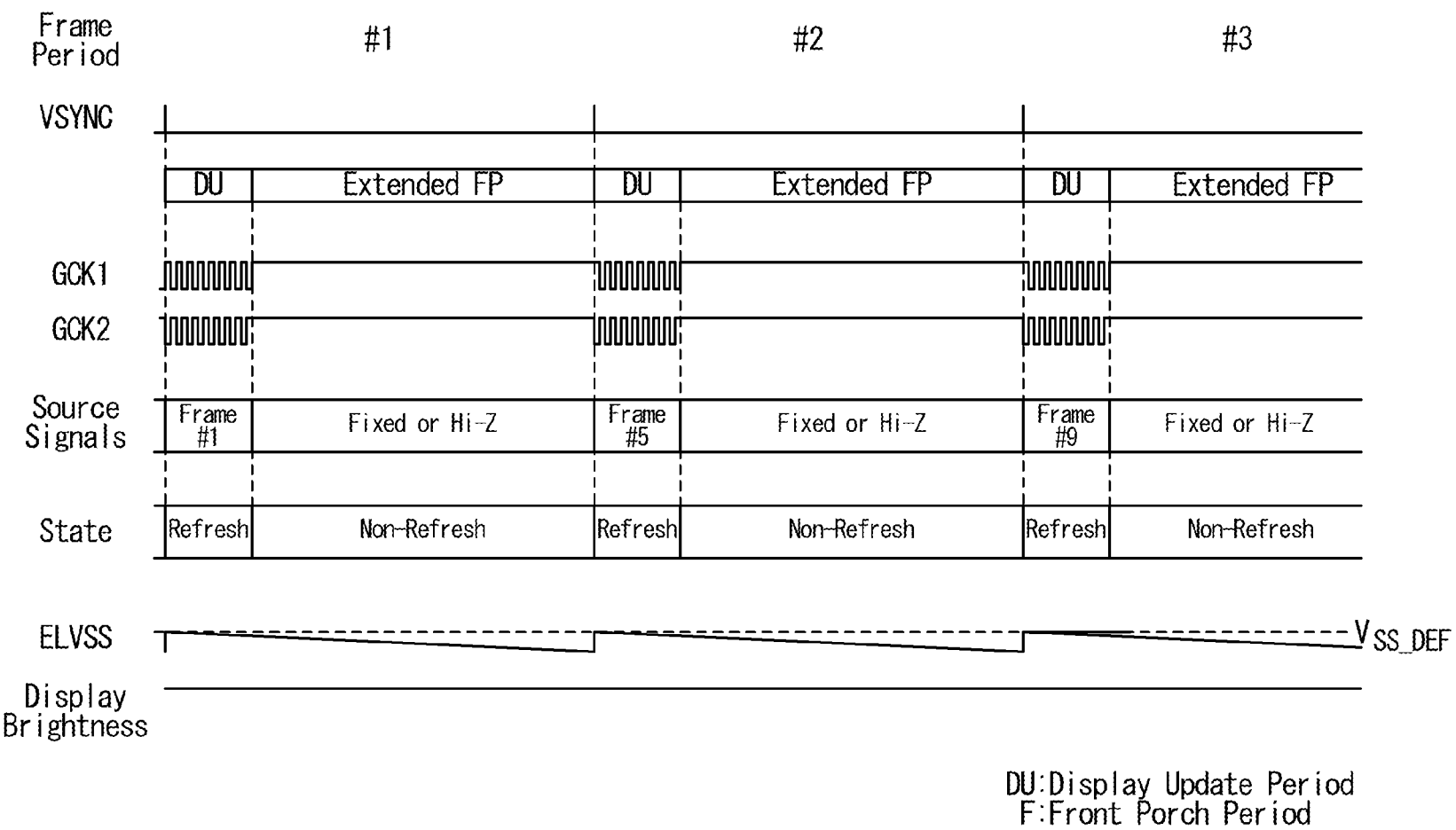
FIG. 12 illustrates another example operation of a display device in an intermittent operation mode, according to one or more embodiments.

FIG. 12 illustrates another example control of the low-side power source voltage ELVSS in the intermittent operation mode, according to other embodiments. In the illustrated embodiment, the front porch period of each frame period is extended to reduce the frame rate (e.g., from 60 Hz to 15 Hz) when the display device 100 is placed in the intermittent operation mode, similarly to the embodiment illustrated in FIG. 9. The timing controller 27 (illustrate in FIG. 3) may be configured to switch the display device 100 to the intermittent operation mode in response to an instruction to reduce the frame rate from the host 200. In the embodiment illustrated in FIG. 12, a refresh period includes a display update period, and a non-refresh period that follows the refresh period includes an extended front porch period that follows the display update period. The low-side power source voltage ELVSS may be gradually decreased at least during the extended front porch period in the intermittent operation mode. In some embodiments, the low-side power source voltage ELVSS may be gradually decreased during both the display update period and the extended front porch period. In other embodiments, the low-side power source voltage ELVSS may be decreased stepwise in the extended front porch period.

The compensation of the decrease in the display brightness level may be achieved by variably controlling or modifying the ratio of the number of pixel circuits 14 that emit light to the total number of the pixel circuits 14 of the display panel 10 (or the ratio of the number of display lines 11 that emit light to the total number of the display lines 11 of the display panel 10) in addition to or in place of the above-described controls of the high-side power source voltage ELVDD and/or the low-side power source voltage ELVSS. In some embodiments, the ratio of the number of pixel circuits 14 that emit light to the total number of the pixel circuits 14 of the display panel 10 is controlled by the duty ratio of the emission control signal ESTV, which controls the assertions of the emission scan signals EM supplied to the respective display lines 11. In such embodiments, a decrease in the display brightness level during a non-refresh period may be compensated by variably controlling the duty ratio of the emission control signal ESTV.

Figure 13:
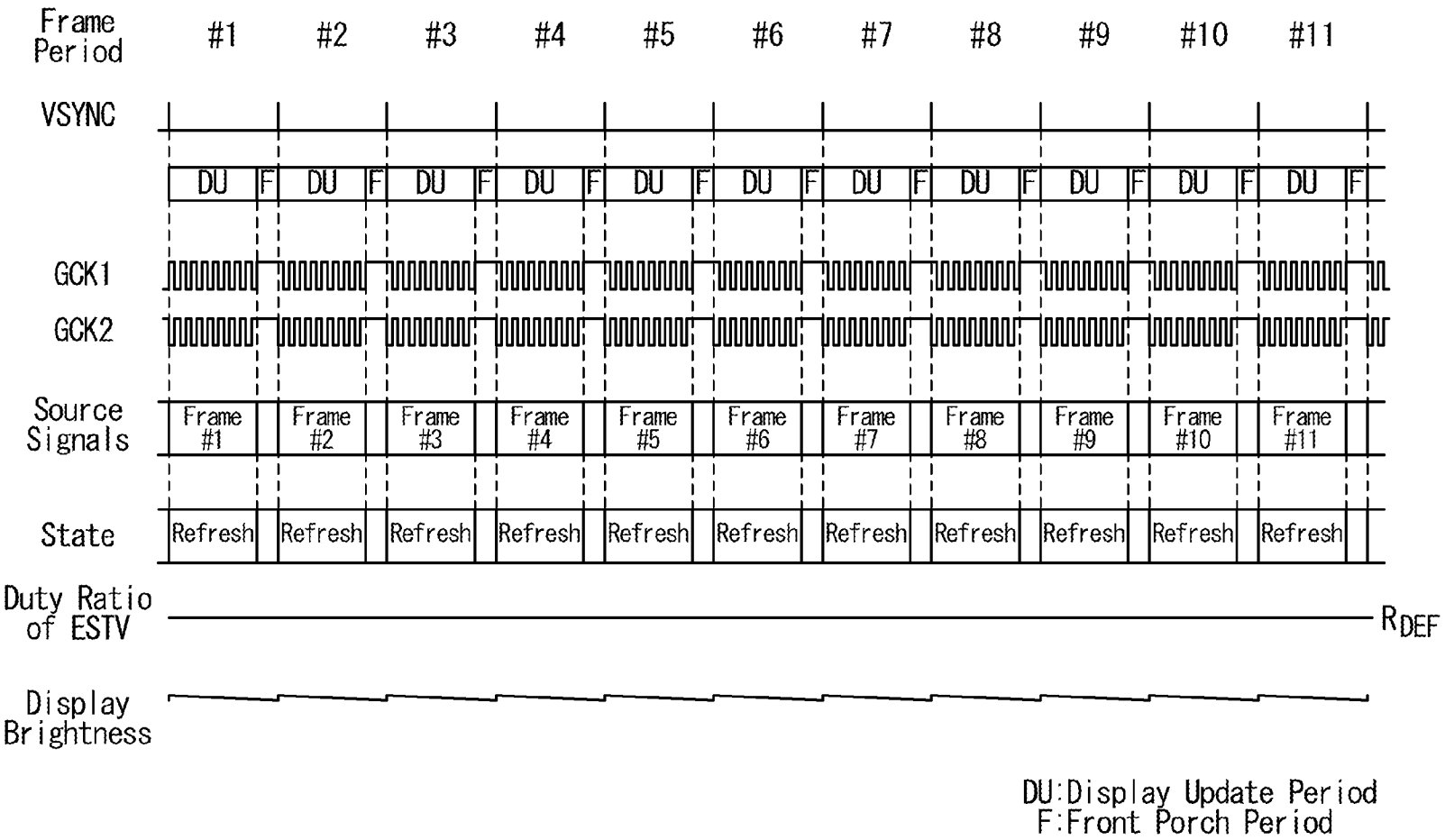
FIG. 13 illustrates an example operation of a display device in a normal operation mode, according to one or more embodiments.
Figure 14:
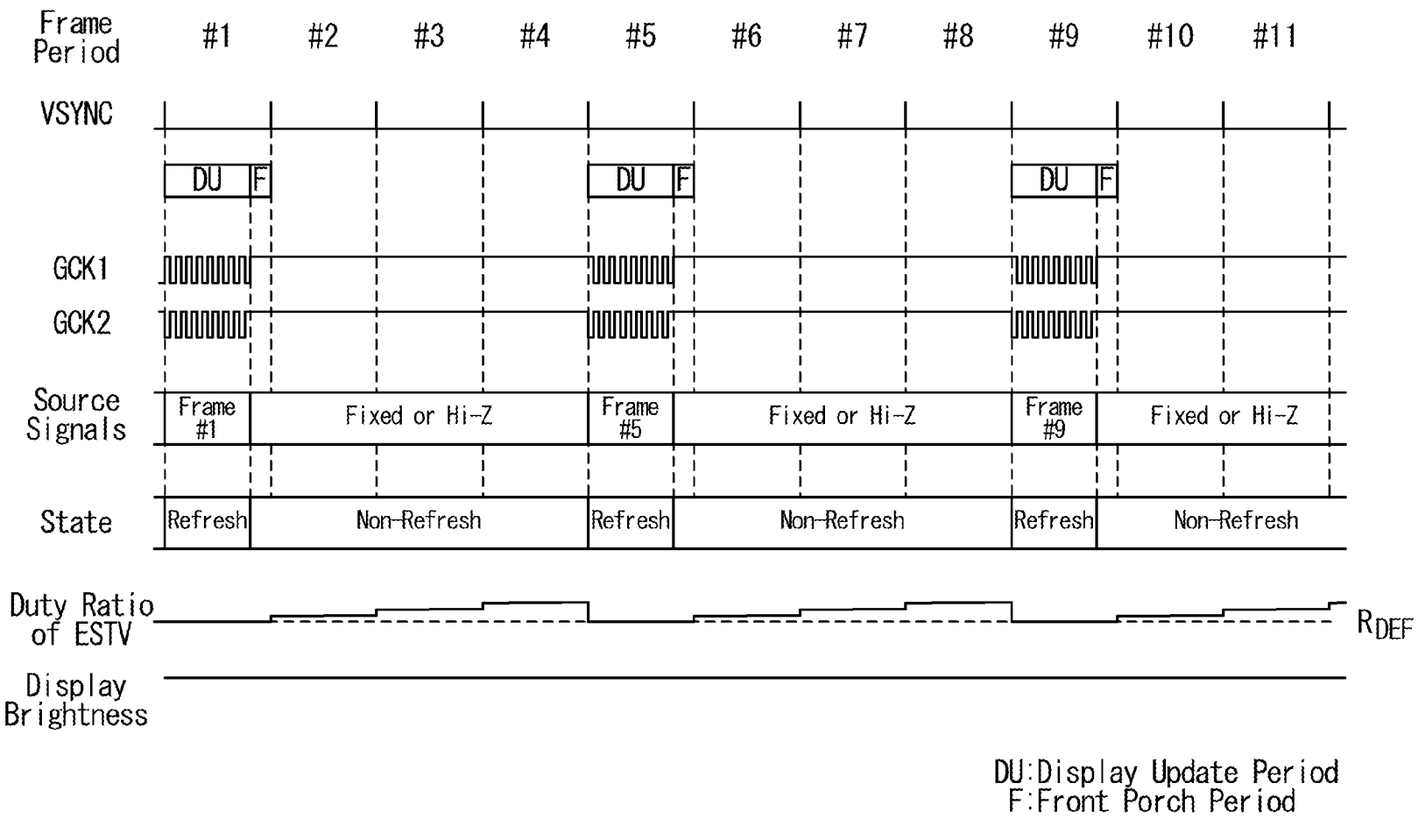
FIG. 14 illustrates an example operation of a display device in an intermittent operation mode, according to one or more embodiments.

FIG. 13 and FIG. 14 illustrate example operations of the display device 100 in the normal operation mode and the intermittent operation mode, respectively, according to such embodiments. In the normal operation mode, as illustrated in FIG. 13, the pixel circuits 14 of the entire display panel 10 are updated every frame period in the normal operation mode, similarly to the embodiments illustrated in FIG. 4 and FIG. 10. The emission pulse controller 34 is configured to keep the duty ratio of the emission control signal ESTV constant in the normal operation mode. In one or more embodiments, the duty ratio of the emission control signal ESTV is kept at a default duty ratio RDEF in the normal operation mode.

In the intermittent operation mode, as illustrated in FIG. 14, the emission pulse controller 34 is configured to variably control or modify the duty ratio of the emission control signal ESTV during the non-refresh periods. The variable control of the emission pulse control signal ESTV may include controlling the duty ratio of the emission control signal ESTV not to be constant. The control of the duty ratio of the emission control signal ESTV may be based on the emission control data stored in the storage 37.

In the embodiment illustrated in FIG. 14, the emission pulse controller 34 is configured to increase the duty ratio of the emission control signal ESTV at least during the non-refresh periods to compensate a decrease in the display brightness level in the intermittent operation mode. In one implementation, the emission pulse controller 34 may be configured to increase the duty ratio of the emission control signal ESTV stepwise at the beginnings of the respective frame periods of the non-refresh period. The emission pulse controller 34 may be configured to increase the duty ratio of the emission control signal ESTV up to a given duty ratio larger than the default duty ratio RDEF at the end of the non-refresh period. The emission pulse controller 34 may be further configured to return the duty ratio of the emission control signal ESTV to the default duty ratio RDEF such that the duty ratio of the emission control signal ESTV is the default duty ratio RDEF at the beginning of the next refresh period.

The duty ratio of the emission control signal ESTV may be controlled based on the emission control data stored in the storage 37 of the display driver 20. The emission control data may be generated and stored into the storage 37 in a calibration process of the display device 100. The emission control data may be generated in a similar manner to the ELVDD control data as described in relation to FIGS. 7A to 7C.

Figure 15:
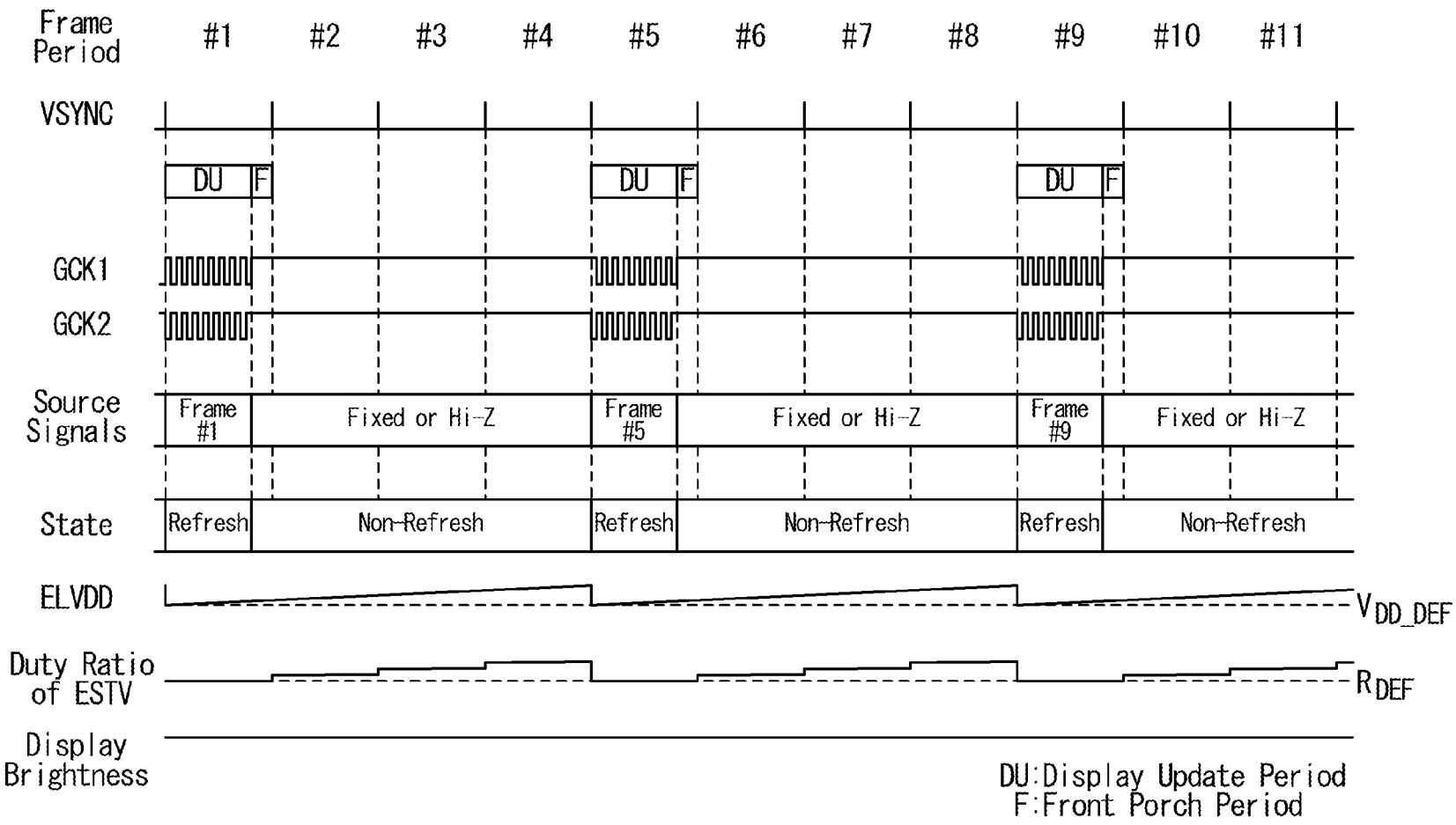
FIG. 15 illustrates an example operation of a display device in an intermittent operation mode, according to one or more embodiments.

In one or more embodiments, one of the above-described controls of the high-side power source voltage ELVDD, the low-side power source voltage ELVSS, and the duty ratio of the emission control signal ESTV may be implemented solely to provide compensation of the decrease in the display brightness level. In other embodiments, two or three of these controls may be simultaneously implemented. For example, as illustrated in FIG. 15, the voltage level of the high-side power source voltage ELVDD and the duty ratio of the emission control signal ESTV are simultaneously controlled to compensate the decrease in the display brightness level in the intermittent operation mode.

Figure 16:
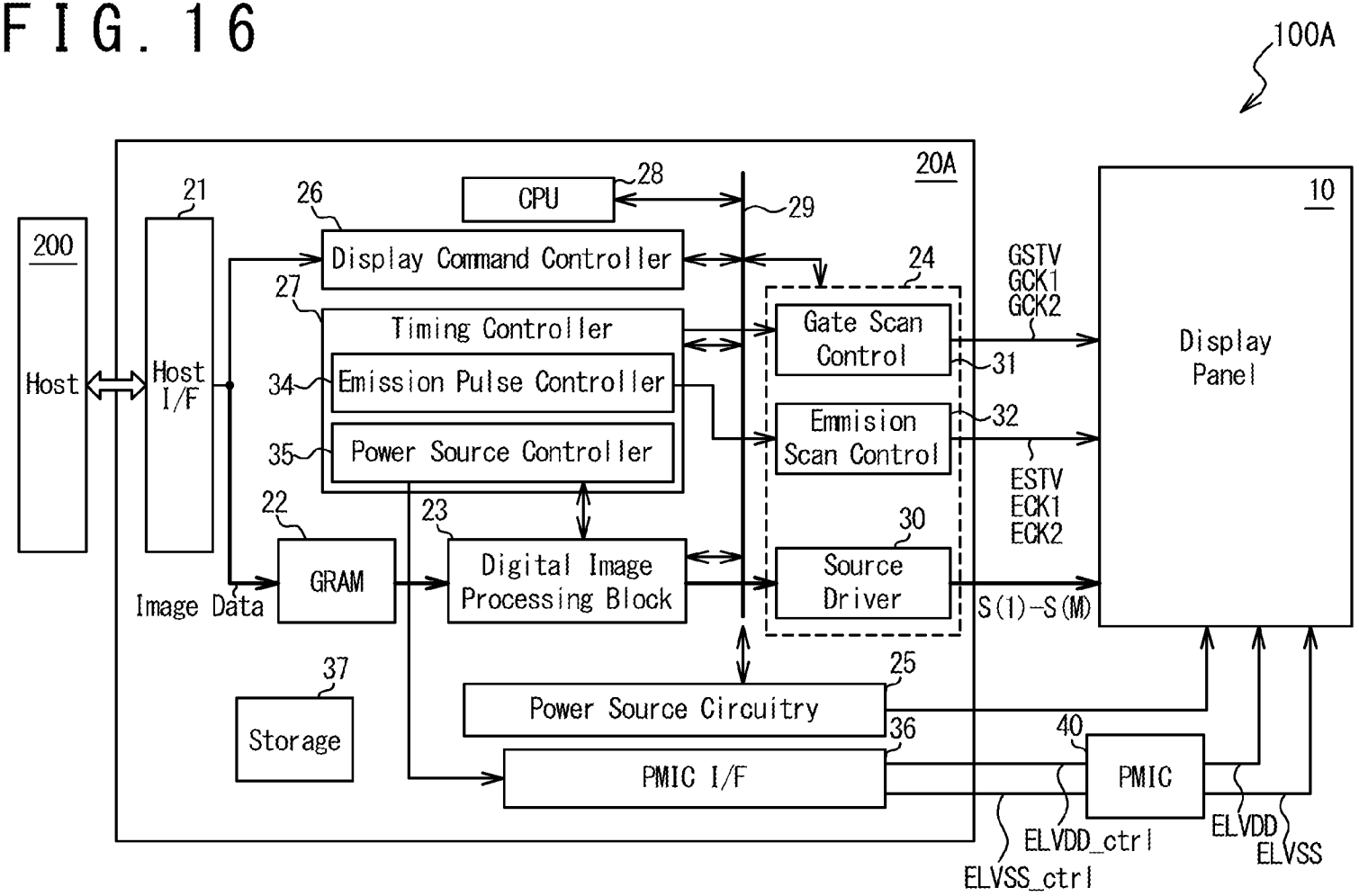
FIG. 16 illustrates an example configuration of a display driver, according to one or more embodiments.

FIG. 16 illustrates an example configuration of a display device 100A, according to other embodiments. In the illustrated embodiment, the display device 100A includes a display driver 20A and a power management integrated circuit (PMIC) 40 configured to generate and supply the high-side power source voltage ELVDD and the low-side power source voltage ELVSS to the display panel 10. The display driver 20A includes a PMIC interface (I/F) 36 configured to generate and supply an ELVDD control signal ELVDD_ctrl and an ELVSS control signal ELVSS_ctrl to the PMIC 40.

In the embodiment illustrated in FIG. 16, the high-side power source voltage ELVDD and the low-side power source voltage ELVSS are controlled similarly to the above-described embodiments except for that the power source controller 35 controls the high-side power source voltage ELVDD and the low-side power source voltage ELVSS by controlling the generation of the ELVDD control signal ELVDD_ctrl and the ELVSS control signal ELVSS_ctrl. The ELVDD control signal ELVDD_ctrl may be generated to keep the high-side power source voltage ELVDD constant in the normal operation mode. The ELVDD control signal ELVDD_ctrl may be generated to increase the voltage level of the high-side power source voltage ELVDD at least during the non-refresh periods in the intermittent operation mode. The ELVSS control signal ELVSS_ctrl may be generated to keep the low-side power source voltage ELVSS constant in the normal operation mode. The ELVSS control signal ELVSS_ctrl may be generated to decrease the voltage level of the low-side power source voltage ELVSS at least during the non-refresh periods in the intermittent operation mode.

Thus, the embodiments and examples set forth herein were presented in order to best explain various embodiments and their particular application(s) and to thereby enable those skilled in the art to make and use the embodiments. However, those skilled in the art will recognize that the foregoing description and examples have been presented for the purposes of illustration and example only. The description as set forth is not intended to be exhaustive or to be limiting to the precise form disclosed.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

signal supply circuitry configured to update a display panel during a refresh period and not update the display panel during a non-refresh period that follows the refresh period; and a power source controller configured to modify a power source voltage supplied to the display panel at least during the non-refresh period, wherein the display driver comprises a first mode and a second mode, wherein a first frame period includes a first front porch period in the first mode, wherein a second frame period includes a second front porch period longer than the first front porch period in the second mode, and wherein the non-refresh period comprises the second front porch period.

2. The display driver of claim 1, modifying the power source voltage comprises modifying a high-side power source voltage.

3. The display driver of claim 1, wherein modifying the power source voltage comprises increasing a high-side power source voltage.

4. The display driver of claim 1, wherein modifying the power source voltage comprises modifying the power source voltage during the refresh period and the non-refresh period.

5. The display driver of claim 1, wherein modifying the power source voltage comprises increasing a high-side power source voltage to compensate a decrease in a display brightness level of the display panel.

6. The display driver of claim 1, wherein the power source controller is configured to control the power source voltage such that a change rate of the power source voltage is variable.

7. The display driver of claim 1, wherein the power source controller is configured to control the power source voltage using predetermined control data stored in a storage of the display driver.

8. The display driver of claim 1, wherein modifying the power source voltage comprises modifying a low-side power source voltage.

9. The display driver of claim 1, wherein modifying the power source voltage comprises decreasing a low-side power source voltage.

10. The display driver of claim 1, wherein the signal supply circuitry is further configured to modify a ratio of a number of pixel circuits that emit light to a total number of pixel circuits of the display panel during the non-refresh period.

11. The display driver of claim 10, wherein modifying the ratio comprises increasing the ratio during the non-refresh period.

12. A display device, comprising:

a display panel; and a display driver configured to:

update the display panel during a refresh period and not update the display panel during a non-refresh period that follows the refresh period; and modify a power source voltage supplied to the display panel at least during the non-refresh period, wherein the display driver comprises a first mode and a second mode, wherein a first frame period includes a first front porch period in the first mode, wherein a second frame period includes a second front porch period longer than the first front porch period in the second mode, and wherein the non-refresh period comprises the second front porch period.

13. The display device of claim 12, wherein the display panel comprises a pixel circuit configured to operate on the power source voltage.

14. The display device of claim 12, wherein modifying the power source voltage comprises increasing a high-side power source voltage.

15. The display device of claim 12, wherein modifying the power source voltage comprises modifying a low-side power source voltage, and wherein the display panel comprises a pixel circuit configured to operate on the low-side power source voltage.

16. A method comprising:

updating a display panel of a display device during a refresh period;

not updating the display panel during a non-refresh period that follows the refresh period; and modifying a power source voltage supplied to the display panel at least during the non-refresh period, wherein the display device comprises a first mode and a second mode, wherein a first frame period includes a first front porch period in the first mode, wherein a second frame period includes a second front porch period longer than the first front porch period in the second mode, and wherein the non-refresh period comprises the second front porch period.

17. The method of claim 16, wherein modifying the power source voltage comprises increasing a high-side power source voltage.

18. The method of claim 16, wherein modifying the power source voltage comprises decreasing a low-side power source voltage supplied to the display panel at least during the non-refresh period.

19. The method of claim 16, further comprising modifying a ratio of a number of pixel circuits that emit light to a total number of pixel circuits of the display panel during the non-refresh period.

* * * * *